US012146316B2

(12) United States Patent
Devlin et al.

(10) Patent No.: US 12,146,316 B2
(45) Date of Patent: Nov. 19, 2024

(54) EXPANSION JOINT COVER

(71) Applicants: Seamus Devlin, Clonakilty (IE); Tracey Devlin, Clonakilty (IE)

(72) Inventors: Seamus Devlin, Clonakilty (IE); Tracey Devlin, Clonakilty (IE)

( * ) Notice: Subject to any disclaimer, the term of this patent is extended or adjusted under 35 U.S.C. 154(b) by 186 days.

(21) Appl. No.: 17/909,124

(22) PCT Filed: Jan. 22, 2021

(86) PCT No.: PCT/EP2021/051411
§ 371 (c)(1),
(2) Date: Sep. 2, 2022

(87) PCT Pub. No.: WO2021/175509
PCT Pub. Date: Sep. 10, 2021

(65) Prior Publication Data

US 2023/0100651 A1 Mar. 30, 2023

(30) Foreign Application Priority Data

Mar. 3, 2020 (GB) ..... 2003017

(51) Int. Cl.
*E04B 1/68* (2006.01)

(52) U.S. Cl.
CPC ..... *E04B 1/6804* (2013.01)

(58) Field of Classification Search
CPC ..... E04B 1/6804; E04B 1/68
(Continued)

(56) References Cited

U.S. PATENT DOCUMENTS 3,183,626 A * 5/1965 Schmitt ..... E04B 1/6815 52/459
3,659,390 A * 5/1972 Balzer ..... E04B 1/6804 404/69

(Continued)

FOREIGN PATENT DOCUMENTS

CN 2354986 12/1999
CN 205171359 4/2016

(Continued)

OTHER PUBLICATIONS

Machine translation for JP 5659947 (Year: 1981).*
International Search Report issued in co-pending International Application No. PCT/EP2021/051411 on Apr. 13, 2021.

*Primary Examiner* — Paola Agudelo
(74) *Attorney, Agent, or Firm* — Whiteford, Taylor & Preston, LLP; Gregory M. Stone

(57) ABSTRACT

An expansion joint cover for insertion in an expansion gap comprising a first frame section for attachment to a substrate at one side of the expansion gap, the first frame section having a flat surface; a second frame section for attachment to a substrate at an opposite side of the expansion gap, the second frame section having a first connector; a centre section configured to span the expansion gap and slide on the flat surface of the first frame section, the centre section having a second connector; and a linkage section configured to engage with the first and second connectors to connect the centre section to the second frame section, wherein the linkage section can pivot within the first and second connectors to allow movement of the centre section with respect to the second frame section.

28 Claims, 31 Drawing Sheets

(58) Field of Classification Search
USPC ..... 52/396.04
See application file for complete search history.

(56) References Cited

U.S. PATENT DOCUMENTS

| | | | | | |
|---|---|---|---|---|---|
| 4,381,324 | A * | 4/1983 | Ellingson, Jr. | E04F 19/10 | 428/53 |
| 5,078,529 | A * | 1/1992 | Moulton | E04B 1/6804 | 403/388 |
| 5,297,372 | A * | 3/1994 | Nicholas | E04B 1/6804 | 52/468 |
| 5,400,559 | A * | 3/1995 | Nicholas | E01D 19/06 | 404/55 |
| 6,499,265 | B2 * | 12/2002 | Shreiner | E04B 1/681 | 52/468 |
| 6,527,467 | B2 * | 3/2003 | Betts | E01D 19/065 | 52/393 |
| 8,887,463 | B2 * | 11/2014 | Derrigan | E02D 17/10 | 52/573.1 |
| 10,858,826 | B2 * | 12/2020 | Gebhardt | E04B 1/388 | |
| 2008/0229682 | A1 * | 9/2008 | Torsani | E04B 1/681 | 403/220 |
| 2014/0083036 | A1 * | 3/2014 | Bazzarini | F21V 33/006 | 52/741.1 |

FOREIGN PATENT DOCUMENTS

| | | |
|---|---|---|
| JP | S5659947 | 5/1981 |
| JP | 2003096927 | 4/2003 |
| JP | 5659947 B2 * | 1/2015 |

* cited by examiner

EXPANSION JOINT COVER

TECHNICAL FIELD

The present invention relates to an expansion joint cover.

BACKGROUND AND PRIOR ART

An expansion joint is a physical break or gap in the continuity of construction of a building, bridge and other such structures where movement arising from the drying shrinkage of components laid when wet, the expansion and contraction caused by thermal gain and loss, the impact of wind loading and particularly earthquakes affecting structures built in seismic zones can be accommodated.

These expansion gaps extend through floors, internal and external walls as well as ceilings and roofs effectively dividing a structure into sub-sections which can largely move independently of each other; the aim being to break the aggregate effect of the above movements into smaller more manageable deflections and thereby limit the impact of movement upon a structure.

These expansion gaps require expansion joint covers which are used not only to accommodate the movement but for instance in the case of expansion gaps in floors to allow these floors to be trafficable. Similarly, in external walls and roofs they are used to accommodate movement and to seal the building against the ingress of wind, water and other contaminants.

Due to the growth in world population and the increasing numbers of people living in cities the size of buildings is increasing and the methods of construction changing. The impact of this has been to increase the width of expansion gaps. Similarly, as many larger structures are being built in seismic zones this has had a dramatic impact on expansion gap widths in these areas. This has presented problems in the supply of effective expansion gap covers which can span these wider gaps and accommodate the increased movement.

Existing expansion joint cover design as reflected in prior art collectively does not adequately address the problems of expansion joint covers designed for increasingly wide expansion gaps with similarly increases in anticipated movement.

Currently two types of expansion joint cover are used to serve all or part of these markets. The first of these is described in Patent WO2001098599A1 wherein an expansion joint cover comprising two sloping edge members fixed either side of the expansion gap. These edge members are linked by centring bars which are further attached to a central pan by use of spring-loaded bolts. The central pan has sloping side members the angles of which correspond to the angles of their adjacent side members. Opening and closing of the expansion gap causes the centring bars to rotate thereby causing the central pan to remain in a mid-position. Small gaps are left between the central pan and the two opposing sloping edge members and these gaps accommodate the impact of small deflections upon the structure. Under earthquake conditions the expansion gap can close more than the small gaps can accommodate and in such an event the sloping side angles of the central pan meet the sloping faces of the fixed edge members. In this event the central pan is forced upwards and the springs compressed until point where the pan has been ejected from the gap and the expansion gap can close more fully.

The fundamental problem with the central pan and centring bar system is that it relies solely on centring bars and the attendant bolts and springs to effect movement and displacement of the central pan. As expansion gaps become larger the central pan becomes correspondingly wider. In most instances the central pan incorporates an infill material such as paving or cladding elements and the mass of central pans increases significantly and therefore this load places greater strain upon centring bars, bolts and springs. In addition, centring bars must become much longer to be able to span the wider expansion gaps and the greater movement that these expansion gaps are designed to accommodate. The potential for failure increases with load, the magnitude of displacement and the length of the centring bars particularly during a seismic event where enormous forces are applied over very short timeframes.

Centring bars also extend into the expansion gap and thereby can either inhibit the closing of said gap in response to structural deflection or when the expansion gap closes the centring bars can be damaged and the expansion joint cover system compromised as part of this failure.

A second type of expansion joint cover comprises a central pan or plate system which is affixed by a hinge mechanism to one side member on one side of the expansion gap and the other side is free to move. A small gap is left between the central pan or plate and the opposing side member and this gap accommodates the impact of small deflections upon the structure. Under earthquake conditions the expansion gap can close more than the small gap can accommodate and in such an event the central pan or plate pivots from the fixed, hinged end rotating to allow the expansion gap to close and open. Patent references U.S. Pat. No. 6,430,884 and EP2982797A1 exemplify this type of system where a hinge mechanism is created at one side of the expansion gap and the central pan or plate pivots around this hinge akin to the operation of a door. Various mechanisms are used to return the central plate or pan to its original position including elasticated cords, inertial reels, magnetic contacts and gravity.

The weaknesses in this design are numerous in that the system should not be used in floors where the once the central pan or plate pivots under movement it acts as a trip hazard to pedestrians and will not meet the requirements of current disability legislation. This problem also impedes wheeled vehicles and other traffic. When used in external walls the underlying expansion gap can be left exposed to the elements and the hinged plate subjected to wind loading. In these types of system, the mechanisms used to return the central pan or plate to its original position following a seismic event are complex and cumbersome.

In some instances, services, acoustic suppression materials, fire barriers, waterproofing membranes and other devices may be incorporated within an expansion gap provided the gap is wide enough to accommodate anticipated deflection and not impact the items installed within said expansion gap. As a result, it becomes desirable to be able to inspect these items particularly after a seismic event to determine whether they have remained unaffected or need to be replaced. The normal method of achieving this is to remove the entire expansion joint cover and in doing so abutting finishes are often compromised and must be replaced. Ideally only the central plate or pan would be removed, inspection and where required repairs or replacement of affected parts undertaken, and the central pan or plate replaced afterwards. No such system currently exists.

Accordingly, there is a need to address the above outlined deficiencies of the prior art.

SUMMARY OF THE INVENTION

The present teachings relate to an expansion joint cover for insertion in an expansion gap comprising a first frame section for attachment to a substrate at one side of the expansion gap, the first frame section having a flat surface; a second frame section for attachment to a substrate at an opposite side of the expansion gap, the second frame section having a first connector; a centre section configured to span the expansion gap and slide on the flat surface of the first frame section, the centre section having a second connector; and a linkage section configured to engage with the first and second connectors to connect the centre section to the second frame section, wherein the linkage section can pivot within the first and second connectors to allow movement of the centre section with respect to the second frame section.

The expansion joint cover in accordance with the present teachings may be further configured such that during movement horizontal to the plane of the substrate, at least a portion of the flat surface of the first frame section can slide under at least a portion of the centre section and at least a portion of the centre section can slide on at least a portion of the flat surface.

The expansion joint cover in accordance with the present teachings may be further configured such that when movement horizontal to the plane of the substrate causes the expansion gap to close to a predetermined point, the centre section engages with a portion of the first frame section causing the centre section to move vertically with respect the plane of the substrate.

The expansion joint cover in accordance with the present teachings may be further configured so that when the centre section moves vertically, the linkage section pivots within the first and second connectors to maintain the centre section parallel with the flat surface of the first frame section.

The linkage may be one of (i) a torsion spring, which applies force resisting vertical movement of centre section with respect to the plane of the substrate and (ii) a solid linkage.

The expansion joint cover in accordance with the present teachings may further comprise multiple linkage sections configured to connect the centre section to the second frame section.

Optionally, at least one of the multiple linkage sections is a torsion spring, which applies force resisting vertical movement of centre section with respect to the plane of the substrate and at least one of the multiple linkage sections is a solid linkage.

Optionally, the connectors are C-shaped retainers and the linkage sections are barbell shaped.

The expansion joint cover in accordance with the present teachings may further comprise a first wing section attached to a first side of the central section and extending to the first frame portion.

The expansion joint cover in accordance with the present teachings may further comprise a second wing section attached to a second side of the central section and extending to the second frame portion.

Optionally, the wing section is configured to pivot with respect to the central section.

Optionally, the centre section is a flat plate.

Optionally, the centre section is a pan with central recessed portion.

Optionally, the pan comprises an arm with a roller mechanism configured to slide on the flat surface of the first frame section.

Optionally, the first frame section further comprises an inclined portion extending from the flat surface configured for engaging with the pan.

The expansion joint cover in accordance with the present teachings may further comprise a backer rod topped by a sealant between the pan and at least one of the first frame section and second frame section.

The sealant may be configured to stretch during movement horizontal to the plane of the substrate.

Optionally, the first frame section comprises a first recessed portion, the pan comprises a second recessed portion and a pre-extruded seal connects the first frame section and the pan via the first and second recessed portions.

Optionally, the second frame section comprises a third recessed portion, the pan comprises a fourth recessed portion and a seal connects the second frame section and the pan via the third and fourth recessed portions.

The pan may comprise at least one of a first side inclining towards the first frame portion and a second side inclining towards the second frame portion.

The expansion joint cover may further comprise a first protrusion which extends from the flat surface of the first frame section and is configured such that the centre section can slide on the first protrusion.

The expansion joint cover may also comprise a second protrusion which extends from the centre section and is configured to engage with the first protrusion.

The present teachings also relate to an expansion joint cover for insertion in an expansion gap comprising a first frame section for attachment to a substrate at one side of the expansion gap, the first frame section having a flat surface; a second frame section for attachment to a substrate at an opposite side of the expansion gap, the second frame section having an upper section with a first connector and a lower section with a second connector; a centre section configured to span the expansion gap and slide on the flat surface of the first frame section, the centre section detachably connected to the upper section of the second frame portion; and a linkage section configured to engage with the first and second connectors to connect the upper section of the second frame section with the lower section of the second frame section; wherein the linkage section can pivot within the first and second connectors to allow movement of the upper section with respect to the lower section and the centre section is removable from the expansion joint cover by detaching it from the upper section of the second frame section.

Optionally, the centre section is a pan configured for attachment to the upper frame section using a countersink screw that extends through a portion of the pan into the upper frame section.

Optionally, the centre section is a pan configured for attachment to the upper frame section using a bolt that extends through a portion of the pan and through a portion into the upper frame section.

The bolt may extend through an upstanding wall of the pan and through an upstanding portion of the upper frame section.

Optionally, the centre section is a flat plate configured for attachment to the upper frame section using a countersink screw that extends through the plate into the upper frame section.

The expansion joint cover may further comprise a first protrusion which extends from the flat surface of the first frame section and is configured such that the centre section can slide on the first protrusion.

The expansion joint cover may also comprise a second protrusion which extends from the centre section and is configured to engage with the first protrusion.

Figure 35:
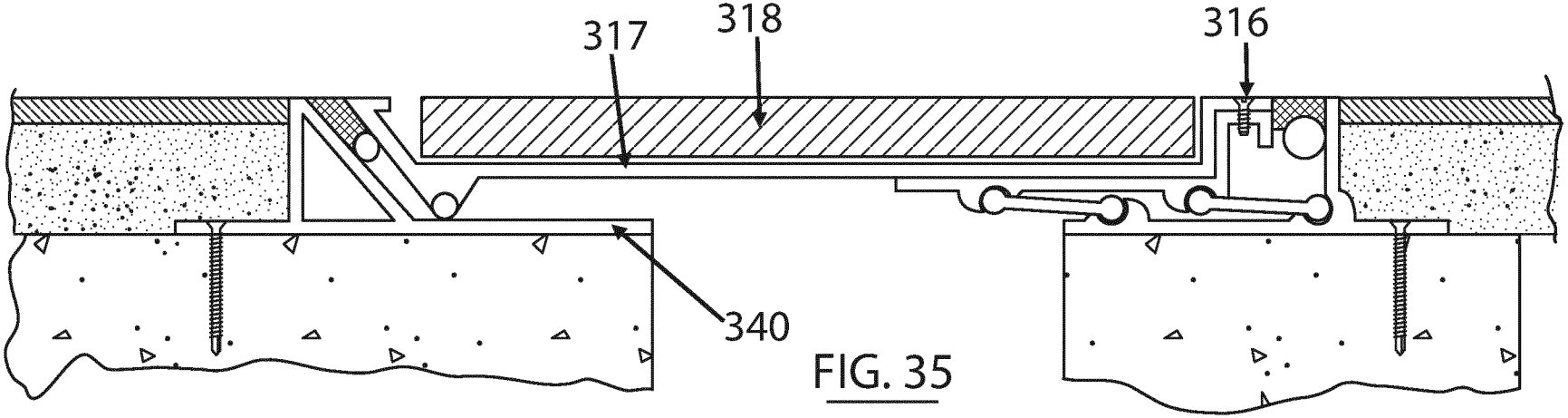
FIG. 35 shows an alternative means of fixing the central pan to the underlying composite frame when compared to the bolting configuration of FIG. 32.
Figure 36:
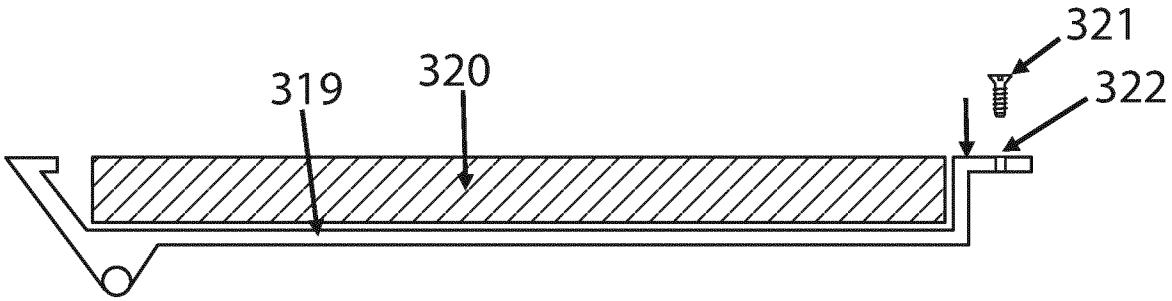
FIG. 36 shows how the alternative means of fixing the central pan to the underlying composite frame shown in FIG.
Figure 36:
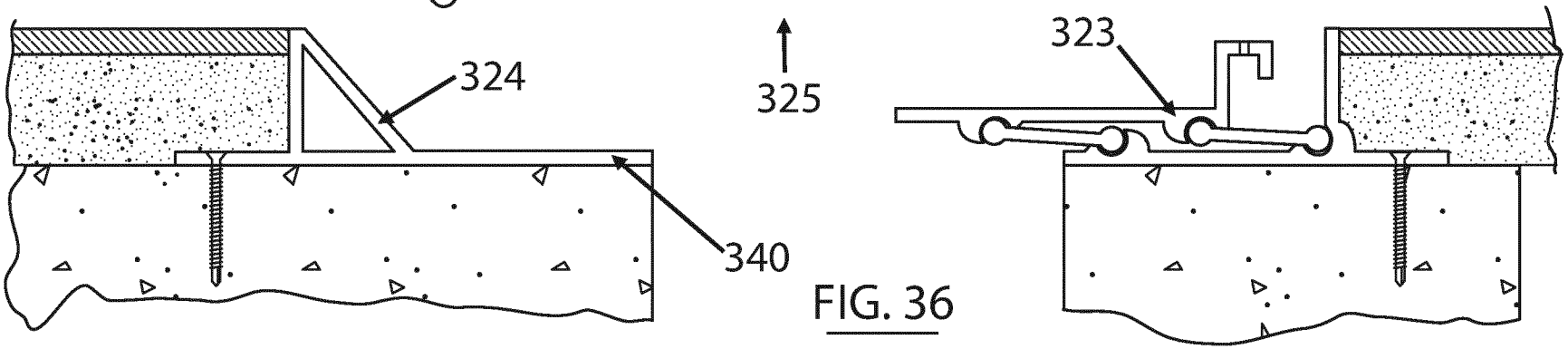
Figure 37:
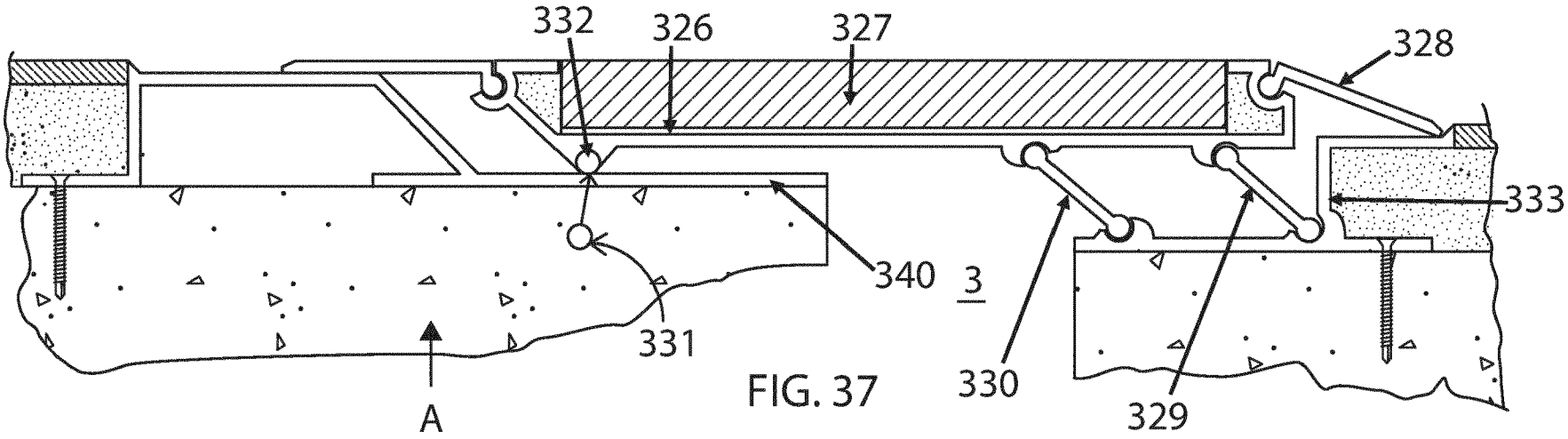
Figure 38:
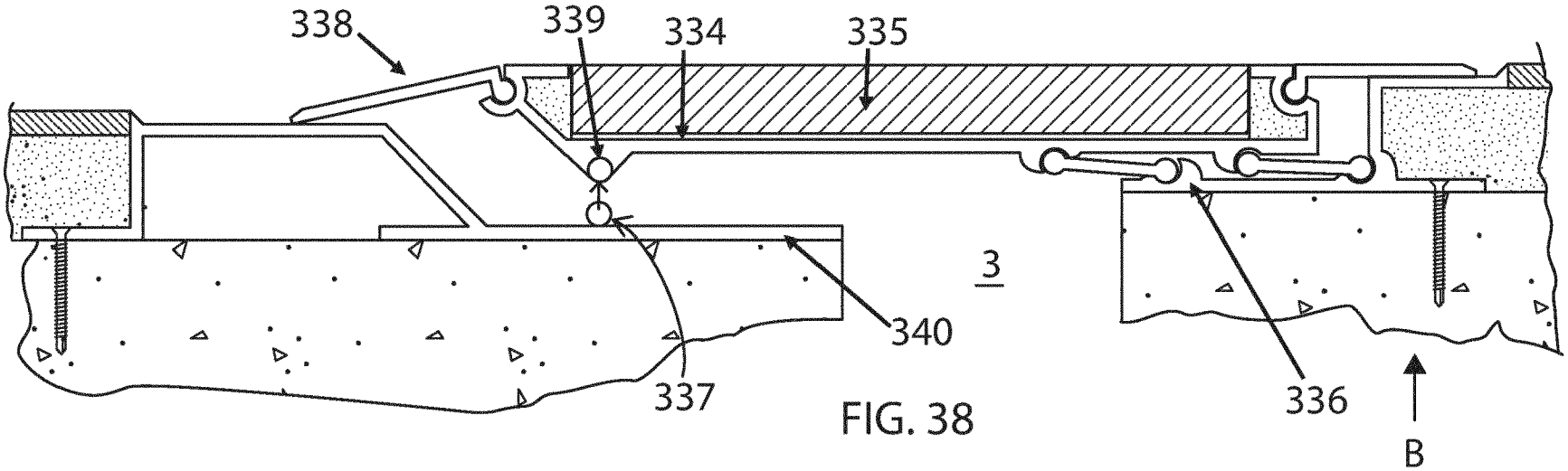
Figure 39:
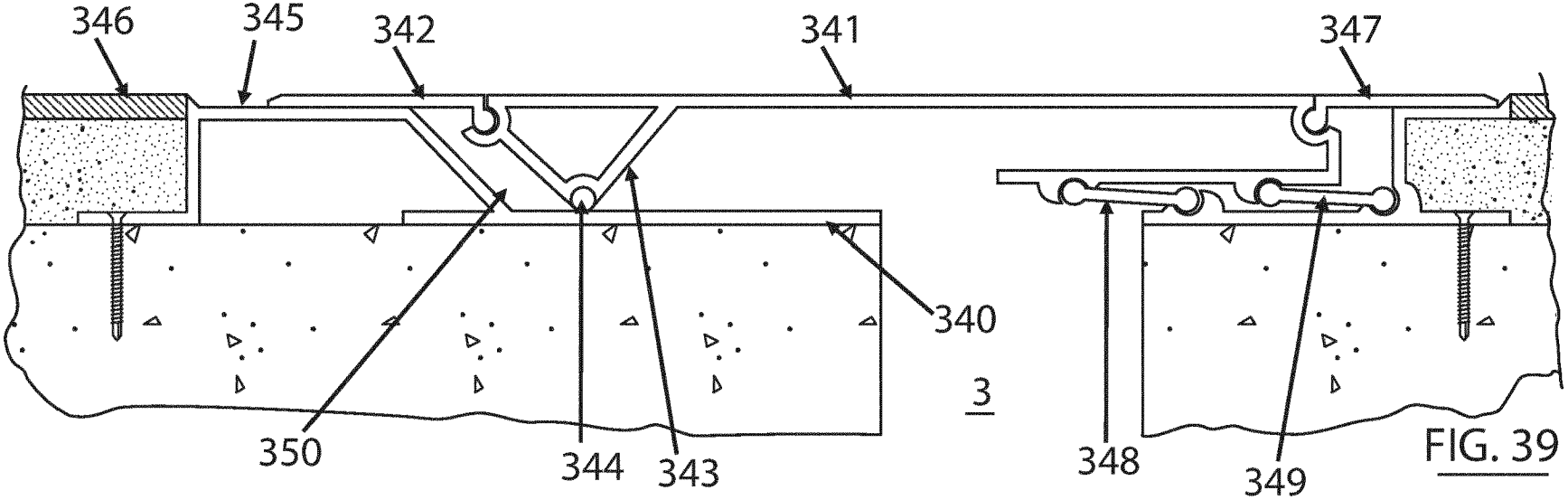
Figure 40:
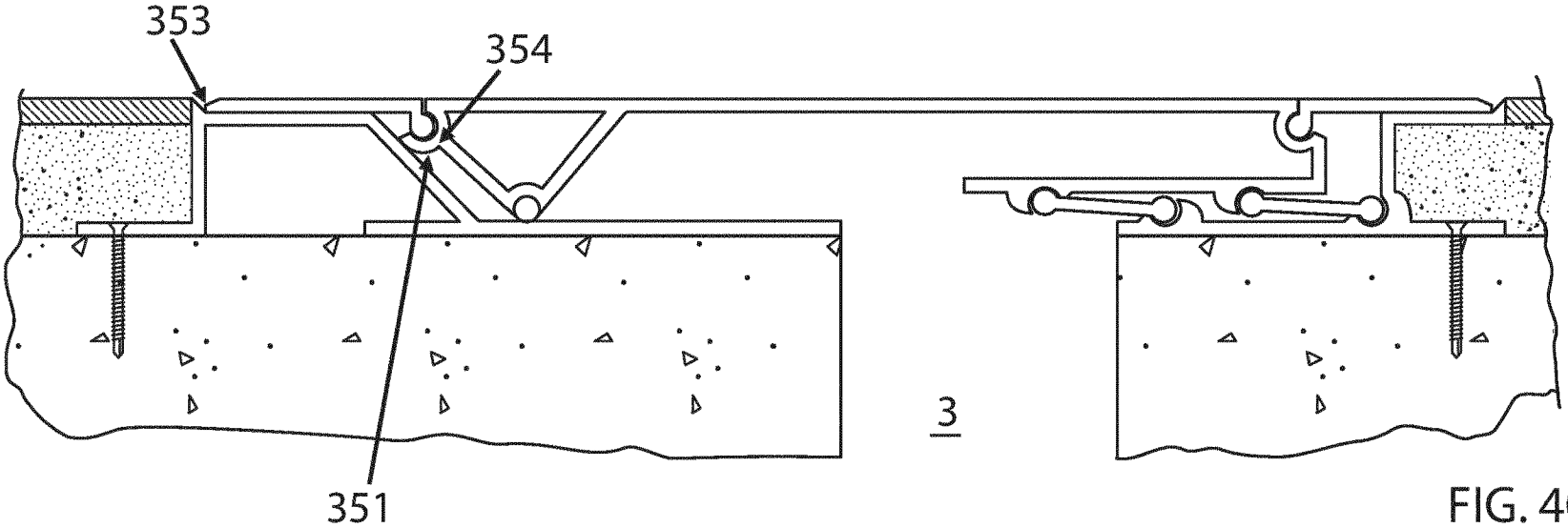
Figure 41:
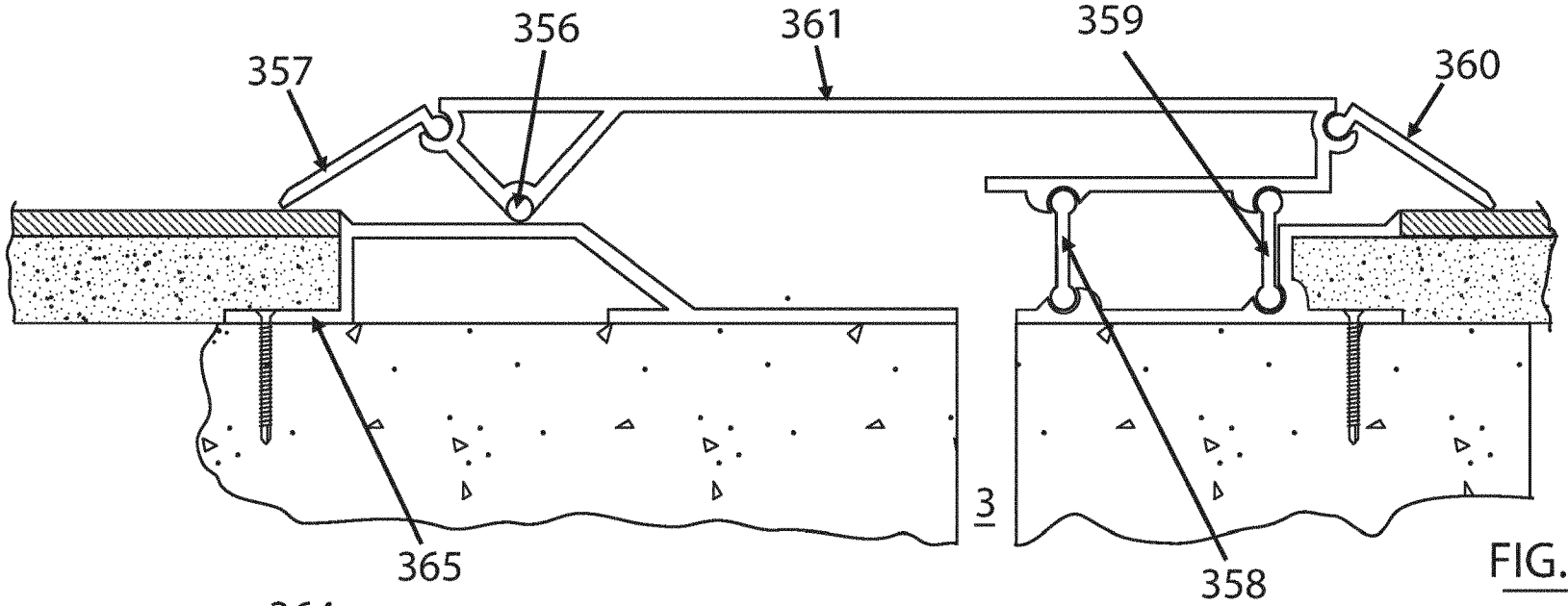
Figure 42:
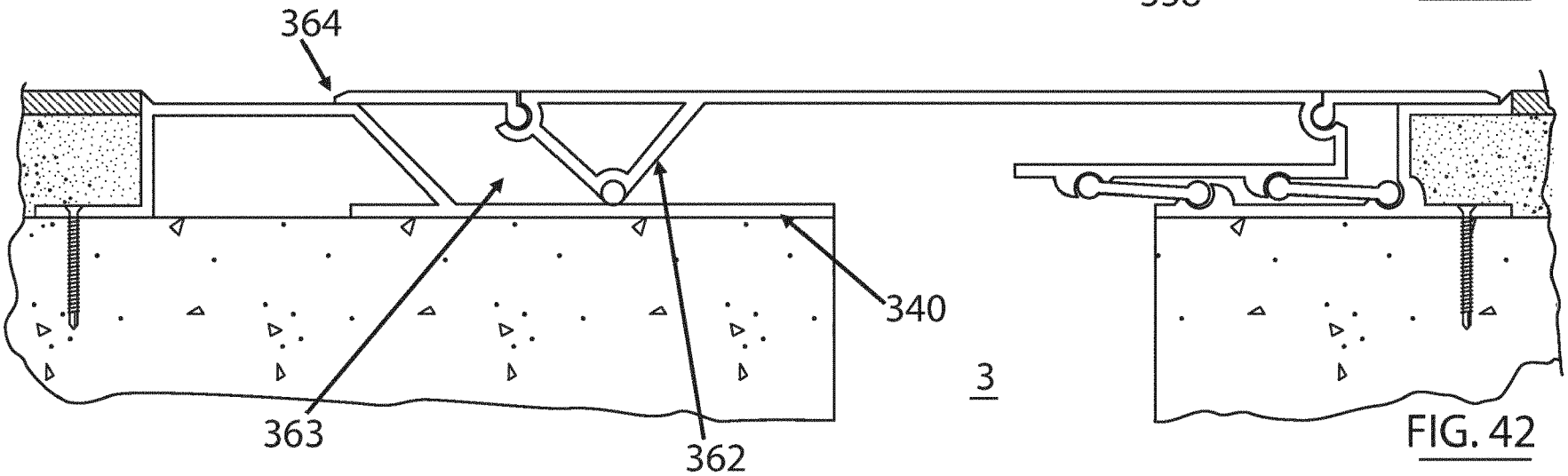
Figure 43:
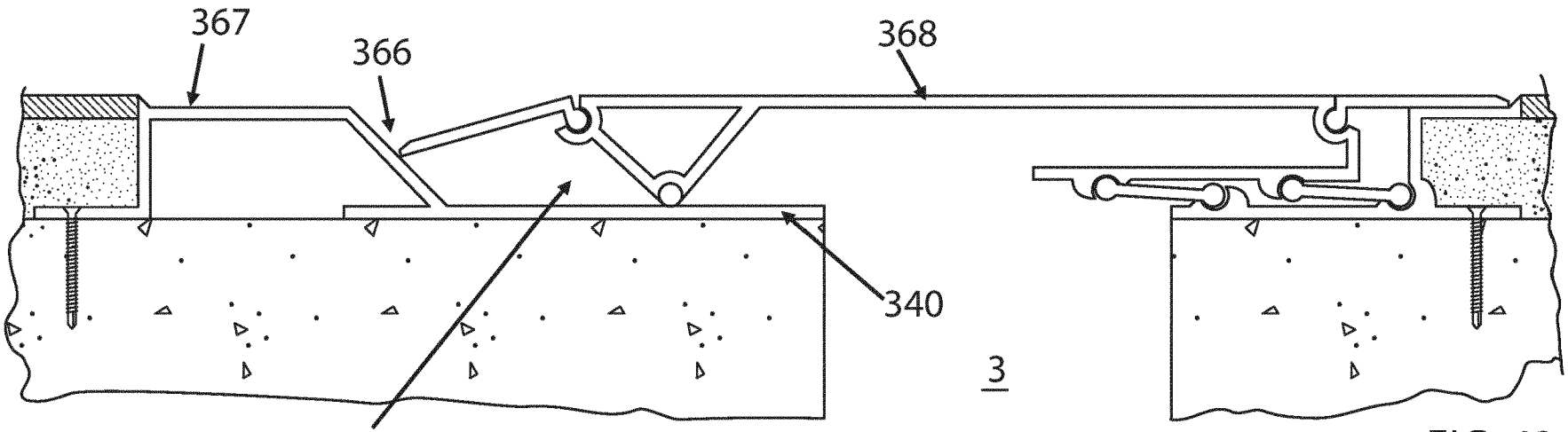
Figure 44:
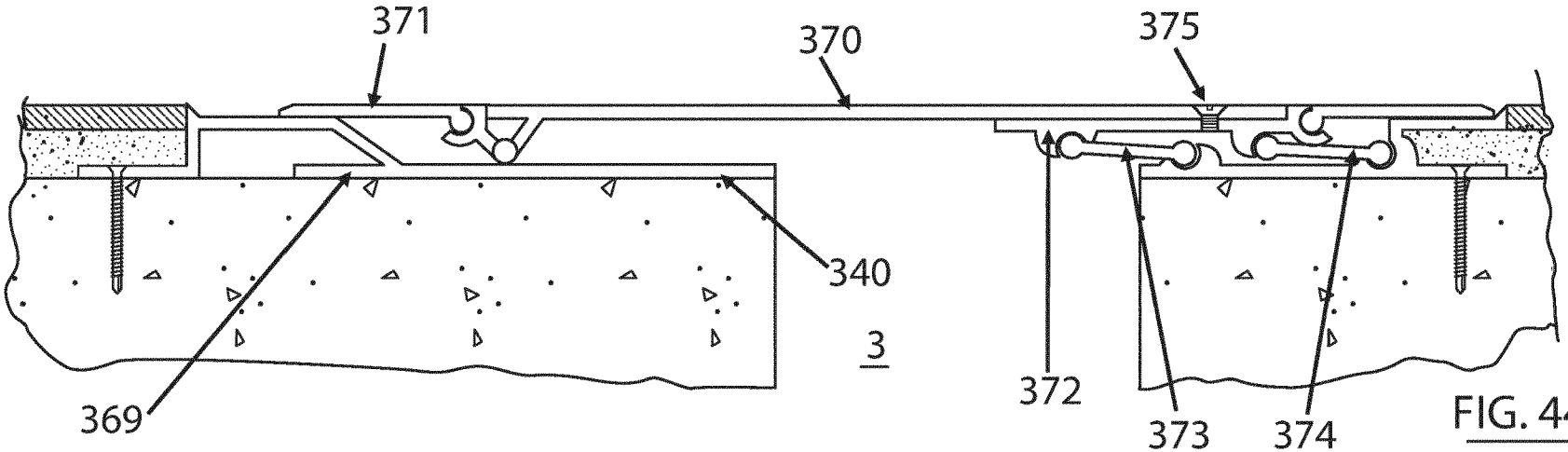
Figure 45:
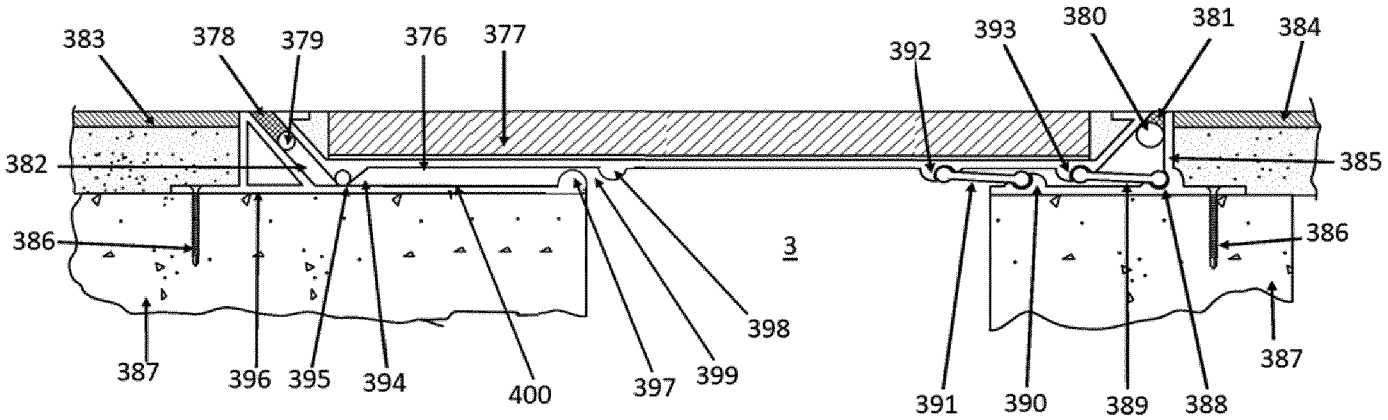
Figure 46:
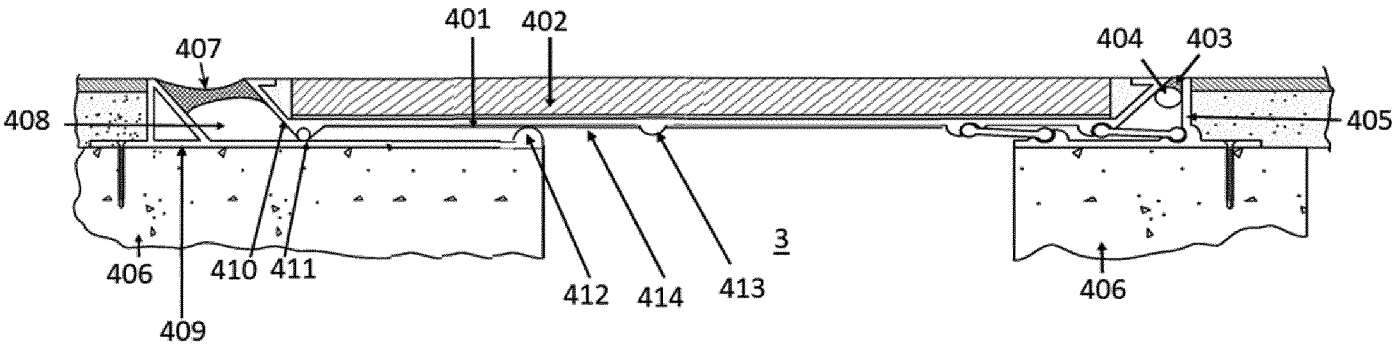
Figure 47:
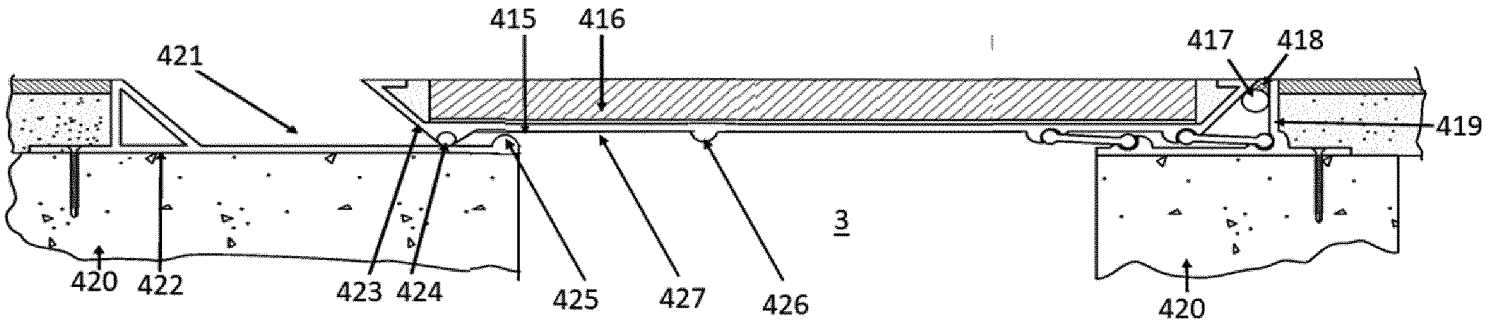
Figure 48:
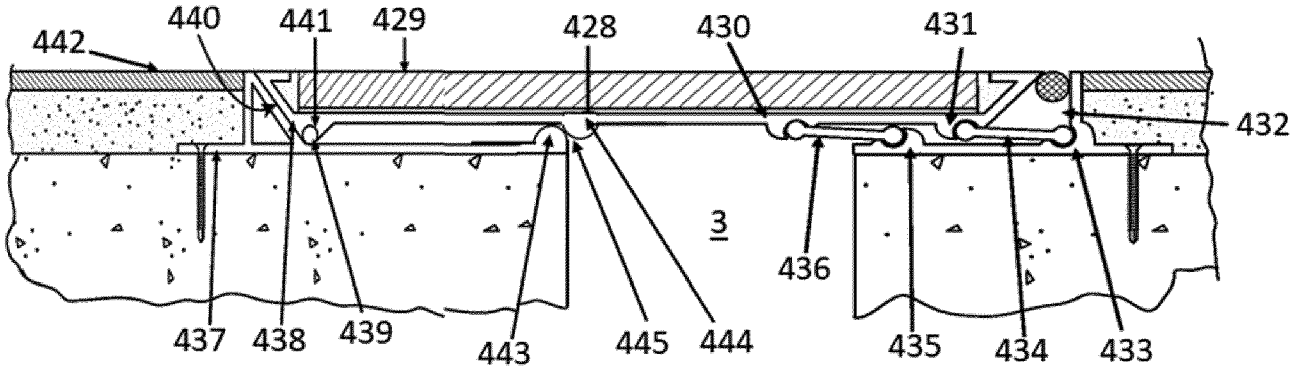
Figure 49:
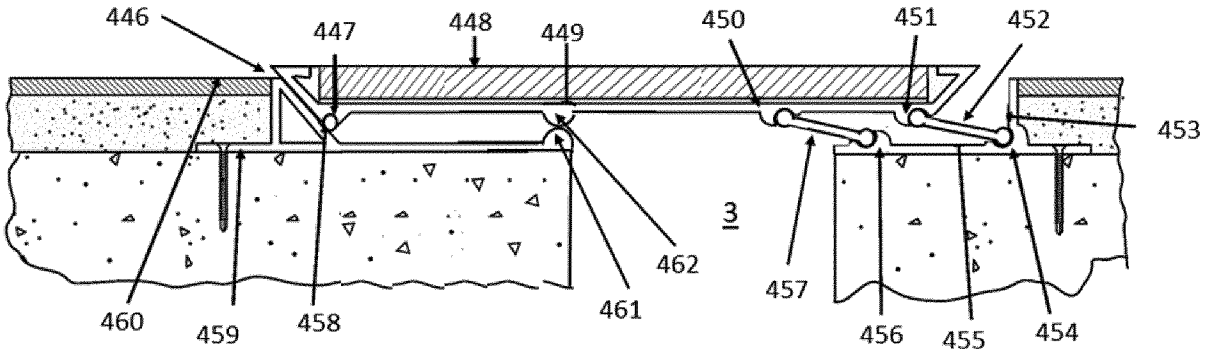
Figure 50:
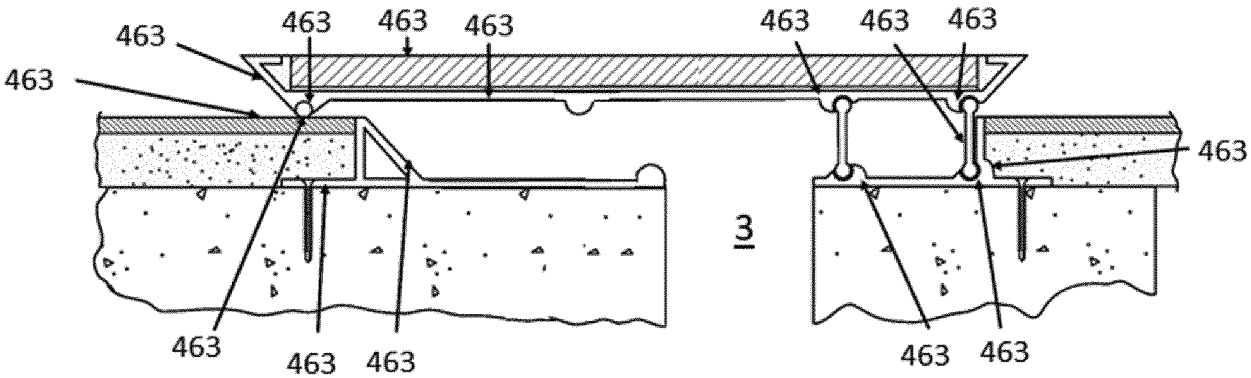

35 allows the central pan with its infill can be removed from the composite frame in an alternative way;

FIG. 37 shows the device previously described with respect to FIGS. 24-29 in accommodating vertical movement;

FIG. 38 shows the device previously described with respect to FIGS. 24-29 in accommodating vertical movement; and FIG. 39 shows a modification of the Type 1 device wherein the central plate is fitted with flanges or wings similar to those illustrated in FIGS. 24 to 28 inclusive and in FIGS. 37 and 38;

FIG. 40 shows the device of FIG. 39 wherein the expansion gap has closed under 'normal movement';

FIG. 41 illustrates the device of FIG. 39 following seismic movement wherein the centre plate is forced upwards, the barbell shaped sections rotate upwards under the deflection forces and the wings or flanges rotate downwards under the force of gravity to form ramps to the centre plate to facilitate traffic across the invention;

FIG. 42 displays the device of FIG. 39 where the expansion gap has opened up under 'normal movement';

FIG. 43 shows the device of FIG. 39 where the expansion gap has opened up under seismic movement where the flange or wing on one side of the said expansion gap slopes downwards to touch the frame on the opposing side of the gap;

FIG. 44 shows a modification of the Type 1 device which has similarities to the embodiment of FIGS. 35 and 36 excepting that the central pan is replaced by a central plate;

FIG. 45 shows a sectional view of another embodiment of the Type 2 device;

FIG. 46 shows a sectional view of the device shown in FIG. 45 after 'normal deflection' has caused the expansion gap to open;

FIG. 47 shows a sectional view of the device shown in FIG. 45 after 'seismic deflection' has caused the expansion gap to open;

FIG. 48 shows a sectional view of the device shown in FIG. 45 after 'normal deflection' has caused the expansion gap to close;

FIG. 49 shows a sectional view of the device shown in FIG. 45 in a situation where movement in excess of 'normal deflection' has occurred such that the central pan has been forced upwards; and FIG. 50 shows a sectional view of the device shown in FIG. 45 following 'seismic deflection' wherein the central pan has been forced fully upwards such that it lies above the surface of abutting finishes and the sealant has failed.

DETAILED DESCRIPTION OF PREFERRED EMBODIMENTS

The present teachings provide an expansion joint cover designed to span an expansion gap in a structure wherein the expansion gap cover moves in response to movements in the underlying structure. The joint cover has been designed to accommodate two types of movement namely cyclical and non-cyclical movement of the structure in response to drying shrinkage, thermal gain and loss and wind loading which is often termed 'normal deflection' and is generally significantly less than the movements experienced during a seismic event where movements are termed 'seismic deflection'.

Structures exhibit two differing movement types (normal and seismic), which may be subdivided into non-cyclical and cyclical movements:

A. 'Normal movement' arises due to the influence of specific non-cyclical and cyclical forces. This is divided as follows:

1. Non-cyclical 'normal movement' which arises typically through drying shrinkage and happens only once
2. Cyclical 'normal movements' which are repeatable and arise from:
   a. Expansion and contraction of building elements due to thermal gain and loss—winter/summer—day/night
   b. Building sway due to wind loading B. Seismic movements which are cyclical in that they are regarded as repeatable.

The joint cover in accordance with the present teachings has been designed to accommodate these differing movement types in two different ways and to allow the cover to be tailored to meet these deflections individually.

In a first embodiment of the present teachings herein described as Type 1 the device is shown in FIGS. 1, 2, 3, 4 and 5.

Figure 1:
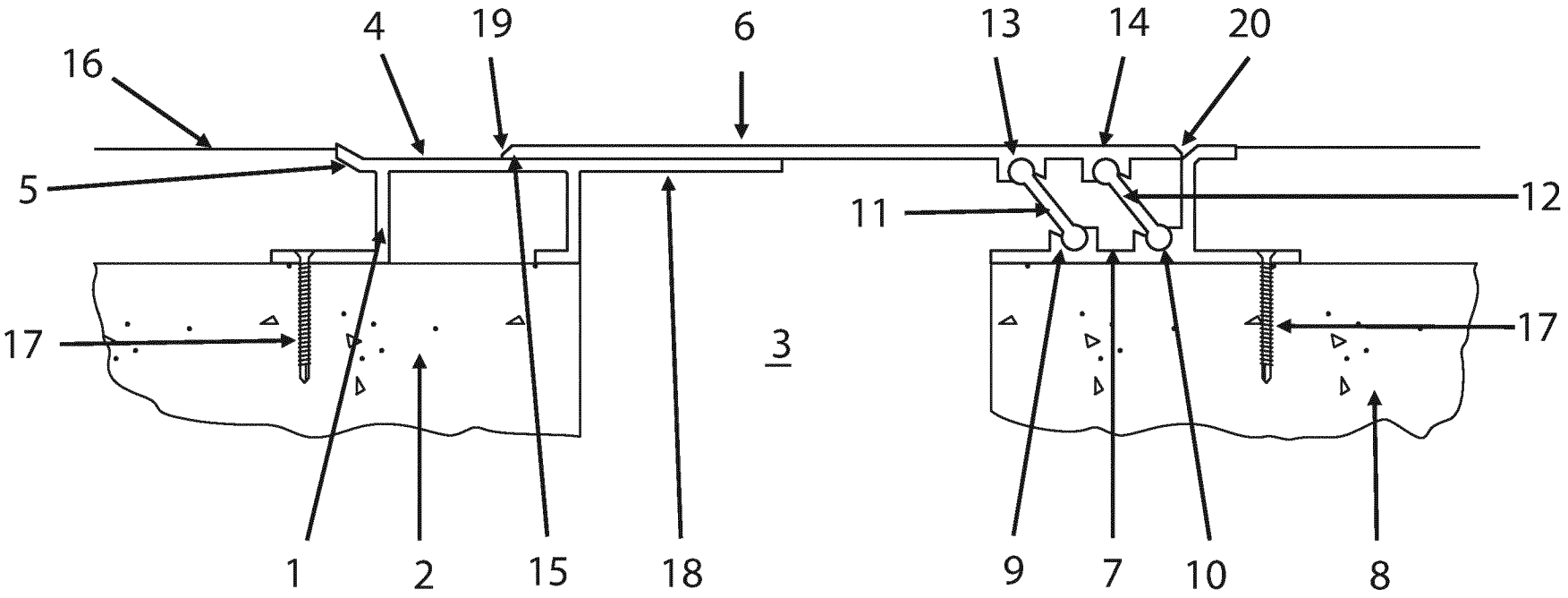
FIG. 1 shows a sectional detail of the proposed Type 1 device in accordance with a first embodiment of the invention, the device is shown spanning an expansion gap at a nominal mid-point state before structural deflections have opened or closed the defined expansion gap.

FIG. 1 shows a sectional view of the Type 1 version of a device designed to span expansion gaps in structures said device designed to open and close in response to movements in the structure whilst completely covering the underlying expansion gap. This figure shows a device comprising a frame 1 designed to be affixed by bolts 17 (or any suitable fixing means) to the substrate 2 on one side of the expansion gap 3 wherein the frame 1 has a substantially flat surface 4 with a sloping upstand 5 at the end of frame 1 said upstand 5 being designed to exert force on the end of the centre plate 6 of a second composite frame causing this centre plate 6 to lift under this pressure. FIG. 1 also shows an assembly designed to be affixed to the opposing side of the expansion gap 3 wherein this assembly comprises a lower frame 7 which is connected to the substrate 8 by bolts 17 (or any suitable fixing means). The lower frame 7 has multiple C-shaped retainers 9 and 10 into which barbell shaped sections 11 and 12 are inserted said barbell-shaped sections 11 and 12 being further attached by C-shaped retainers 13 and 14 to centre plate 6 which forms the upper part of this assembly.

FIG. 1 shows C-shaped retainers 9, 10, 13 and 14 or which have been designed to entrap the ends of the barbell shaped sections 11 whilst at the same time allowing them to rotate in response to pressure on the centre plate 6 from the opposite frame 1. Depending upon the design requirements, anticipated movement and expected load capacity requirements of a structure any number of C-shaped retainers may be formed in the underside of the centre plate 6 and the upper side of the lower frame 7 rather that the four C-shaped retainers shown.

In FIG. 1 the centre plate 6 spans the expansion gap 3 and extends part way across the flat surface 4 of frame 1 such that there is a space 4 between the leading edge 15 of the centre plate 6 and the sloping upstand 5 of the opposing frame 1. In this form when used in a floor location preferentially the ends of the centre plate 6 are chamfered or sloped 19 and 20 to assist in smooth transit across the expansion joint cover by wheeled vehicles and to meet the requirements of current disability legislation. The ends of centre plate 6 may incorporate seals in the underside said seals being used to prevent the ingress of water and other contaminants.

This configuration allows a given magnitude of movement whereby the centre plate 6 is in contact with the flat surface 4 of the frame 1 and accommodates opening and closing movement of the expansion gap 3 whilst providing a substantially flat surface which permits pedestrians and traffic to cross the expansion joint cover. Normally this level of movement is tailored to accommodate both cyclical and non-cyclical movement of the structure in response to drying shrinkage, thermal gain and loss and wind loading. This movement is often described as 'normal deflection'.

Figure 2:
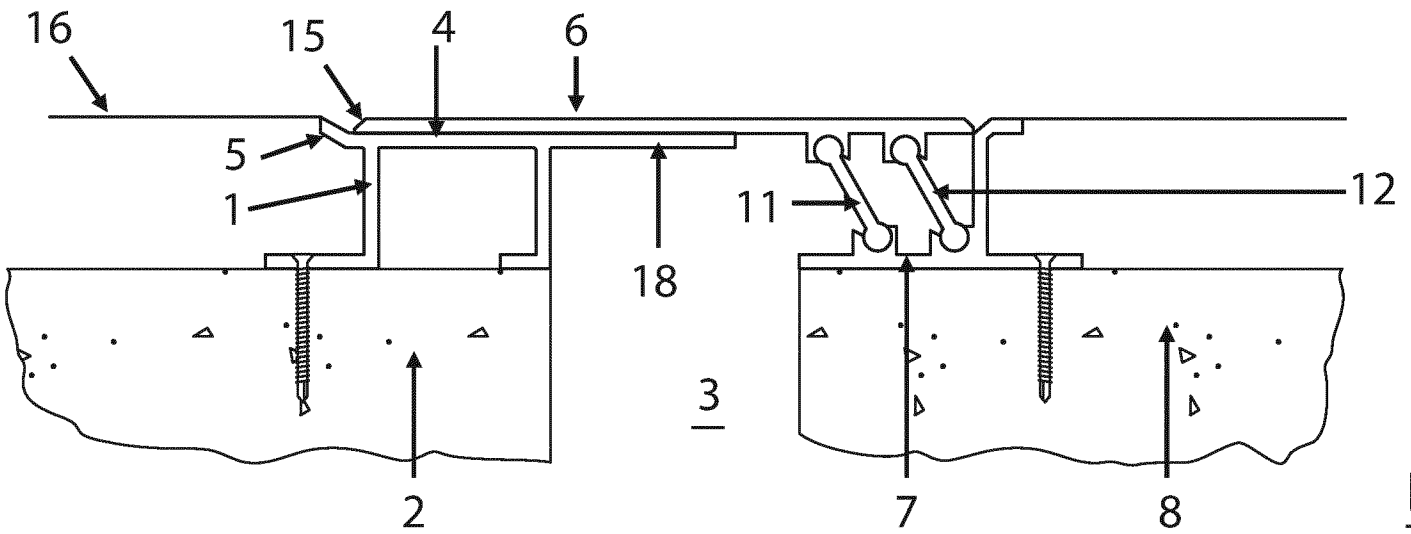
FIG. 2 shows a sectional detail of the proposed Type 1 device spanning an expansion gap when said gap has closed in response to 'normal deflection'.

FIG. 2 shows a sectional detail of the Type 1 invention when the expansion gap 3 has closed in response to 'normal movement' wherein the centre plate moves in response and the leading edge 15 of this centre plate 6 slides across the surface 4 of the opposite frame 1 until it reaches the sloping upstand 5.

As shown in FIG. 2 the flat surface 4 of frame 1 allows the expansion gap 3 to close until the leading edge of the centre plate 15 touches the sloping upstand 5. This closing movement serves to accommodate deflections arising from 'normal deflection' forces. The centre plate 6 remains in contact with the flat surface 4 of the frame 1 and accommodates opening and closing movement of the expansion gap 3 whilst providing a substantially flat surface which permits pedestrians and traffic to cross the expansion joint cover.

Figure 3:
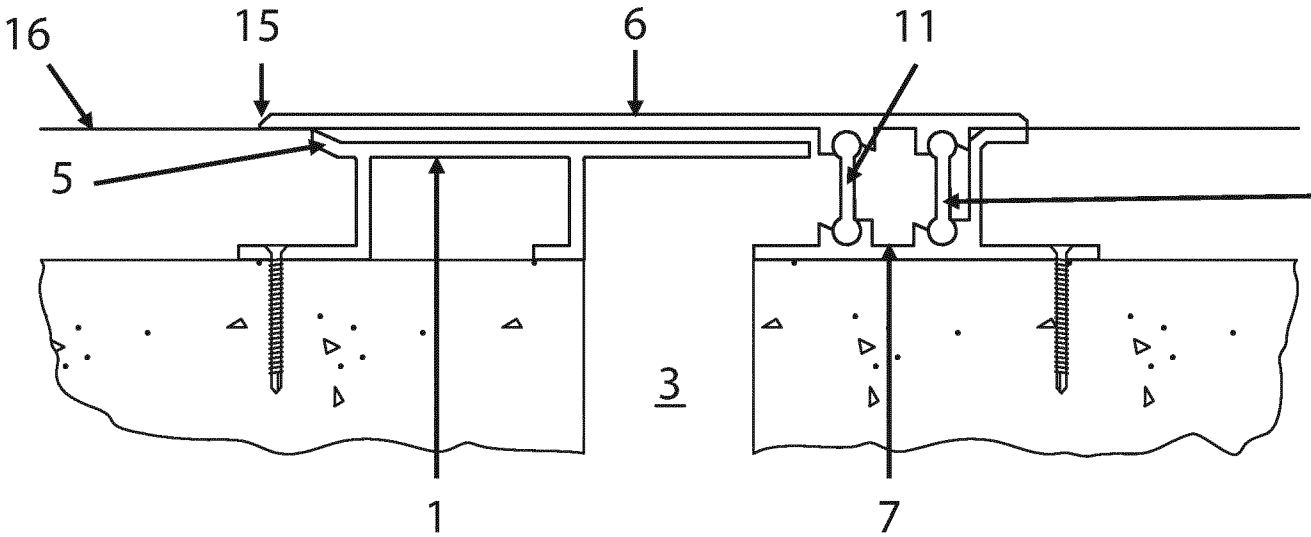
FIG. 3 shows a sectional detail of the proposed Type 1 device spanning an expansion gap when said gap has closed in response to 'seismic deflection'.

FIG. 3 shows a sectional detail of the Type 1 invention when the expansion gap 3 has closed in response to structural deflections greater than 'normal movement' such as seismic movement wherein the leading edge 15 of the centre plate 6 meets the sloping upstand 5 of the opposite frame 1 this centre plate 6 is forced upwards causing the barbell shaped sections 11 and 12 to rotate as shown in FIG. 3 thereby lifting the centre plate 6 whilst ensuring that it remains parallel with the plane of both the lower frame 7 and the opposite frame 1. Further closure of the expansion gap causes the upper plate 6 to extend beyond the end of the opposite plate 1 and across the surface of the substrate 16.

Figure 4:
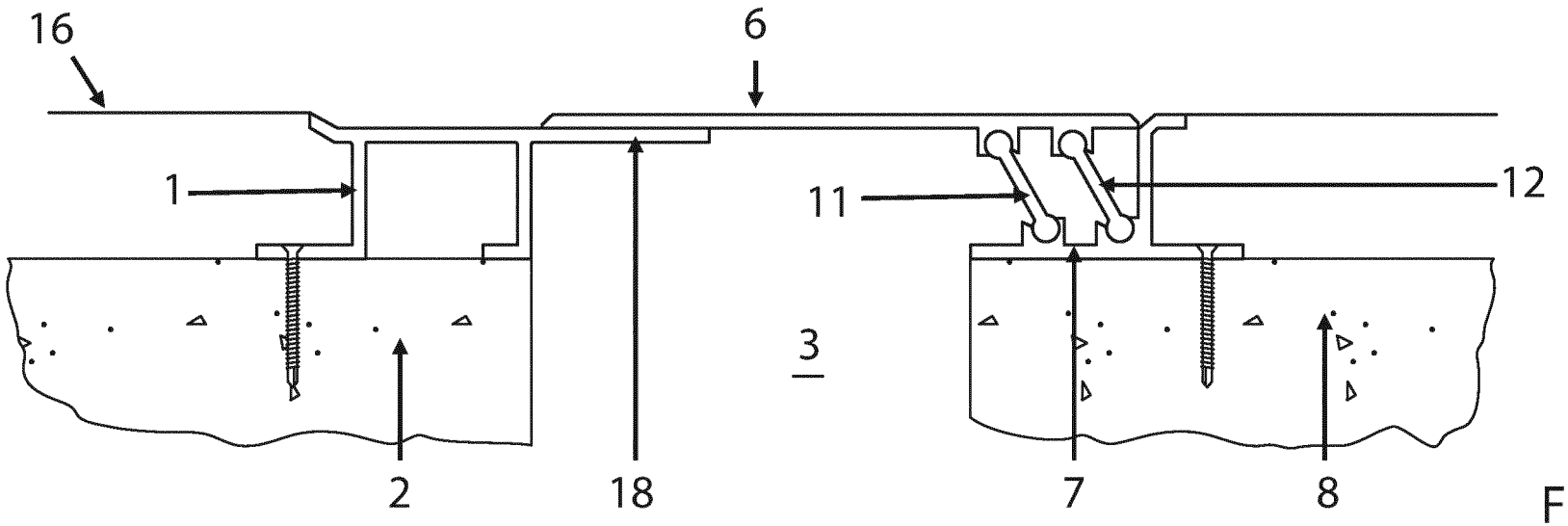
FIG. 4 shows a sectional detail of the proposed Type 1 device spanning an expansion gap when said gap has opened in response to 'normal deflection'.

FIG. 4 shows a sectional detail of the Type 1 invention when the expansion gap 3 has opened in response to 'normal deflection' wherein the substrate 2 and/or 8 withdraws and either frame 1 or the centre plate 6 and lower frame 7 withdraw being connected to each other through the barbell shaped sections 11 and 12 and to the substrate 8 thereby extending to span the increased width of the expansion gap 3. Frame 1 has an extended tongue 18 which supports the end of the centre plate 6 as it spans the expansion gap 3. In this form when used in a floor location preferentially the ends of the centre plate 6 are chamfered or sloped 19 and 20 to assist in smooth transit across the expansion joint cover by wheeled vehicles and to meet the requirements of current disability legislation. The centre plate 6 may incorporate seals in the underside said seals being used to prevent the ingress of water and other contaminants.

As shown in FIG. 4 when the expansion gap 3 opens in response to 'normal deflection' the substrate 2 and/or 8 withdraws and either frame 1 or the centre plate 6 and lower frame 7 withdraw being connected to each other through the barbell shaped sections 11 and 12 and to the substrate 8 thereby extending to span the increased width of the expansion gap 3. Frame 1 has an extended tongue 18 which supports the end of the centre plate 6 as it spans the expansion gap 3. The length of the tongue and the cantilevered portion of the centre plate 6 are generally tailored to accommodate the maximum expected opening movement of the expansion gap 3 whether such movement arises from 'normal deflection' or 'seismic deflection.

Figure 5:
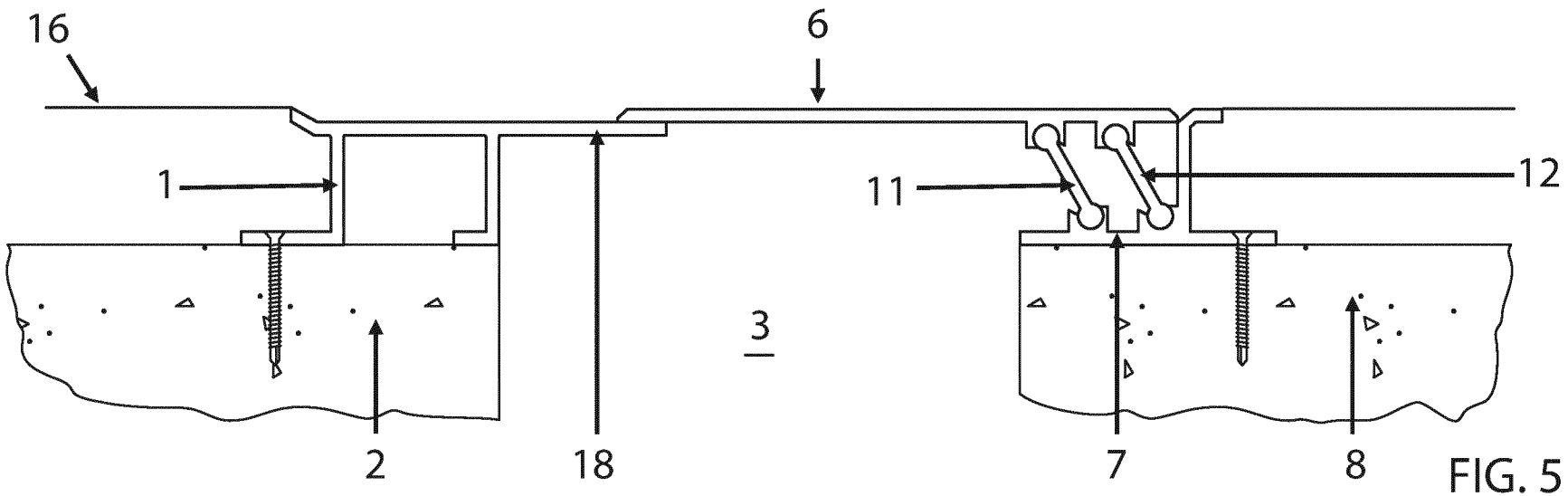
FIG. 5 shows a sectional detail of the proposed Type 1 device spanning an expansion gap when said gap has opened in response to 'seismic deflection'.

FIG. 5 shows a sectional detail of the Type 1 invention when the expansion gap 3 has opened in response to 'seismic deflection' greater than the 'normal deflection' shown in FIG. 4. In this instance the substrate 2 and/or 8 withdraws and either frame 1 or the centre plate 6 and lower frame 7 withdraw being connected to each other through the barbell shaped sections 11 and 12 and to the substrate 8 thereby extending to span the increased width of the expansion gap 3. The centre plate 6 has withdrawn further than shown in FIG. 4 whilst still being supported by the extended tongue 18 and the device continues to span across and cover the expansion gap 3.

FIGS. 1, 2, 3, 4 and 5 also serve to indicate that the movement capacity of the device can be adjusted to meet the movement requirements of a structure by varying the width of the centre plate 6, the length of the flat surface 4 of frame 1 and the width of the tongue 18 extending from frame 1. This is a substantial improvement over the design of other expansion joint systems in that an expansion joint cover can now be readily configured to match the projected deflections of the structure. Similarly, the thickness of these elements can be varied to support anticipated loadings upon the device whilst in service.

Proposed components and assembly details for the device are shown in FIGS. 6 to 13 wherein these components can comprise shaped torsion springs 21 interspersed between barbell-shaped sections 11 and/or 12. Said torsion springs 21 being incorporated to force the centre plate 6 or pan-shaped section back to its original position following a movement cycle wherein the centre plate 6 has been displaced as shown in FIG. 2 and then returned to the positions shown in FIG. 1, FIG. 3 or another position wherein the centre plate 6 returns to rest on the flat surface 4 of the opposing frame 1.

In alternative designs the device can incorporate hydraulic mechanisms as alternatives to torsion springs 21 said hydraulic mechanisms designed to force the centre plate 6 or pan-shaped section back to its original position following a movement cycle wherein the centre plate 6 section has been displaced as shown in FIG. 3 and then returned to the positions shown in FIG. 1, FIG. 2 or another position wherein the centre plate 6 returns to rest on the flat surface 4 of the opposing frame 1.

Figure 6:
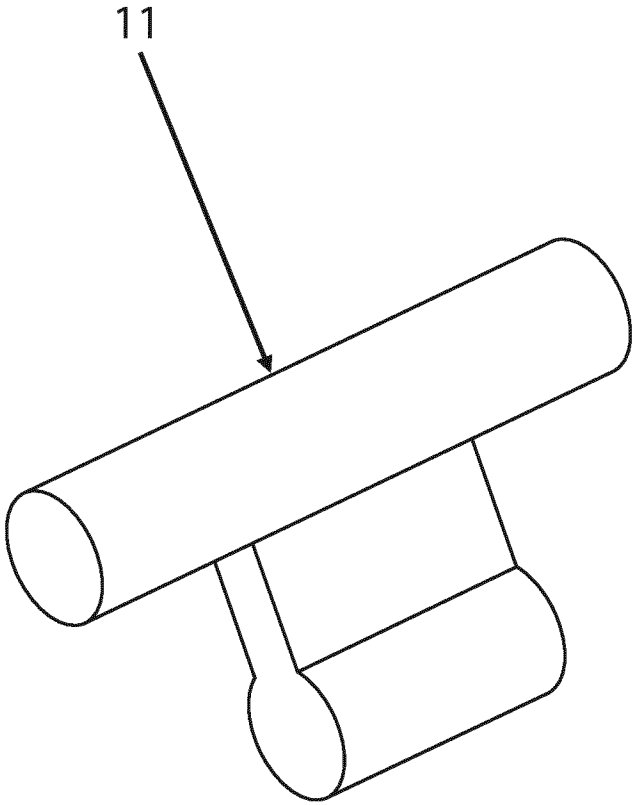
FIG. 6 shows a detail of one possible configuration of a barbell-shaped section of the device in accordance with the present teachings.

FIG. 6 shows one possible configuration of a barbell-shaped section 11 which is used to link the centre plate 6 to the lower frame 7. The rounded ends of this component fit into and are entrapped by C-shaped sections in centre plate 6 and the lower frame 7.

Figure 7:
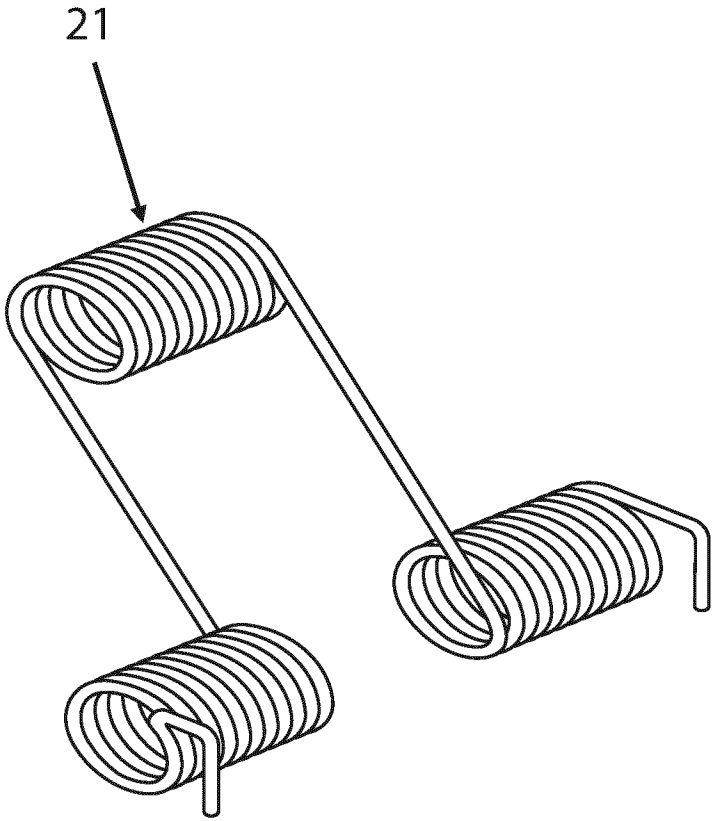
FIG. 7 shows a detail of one possible configuration for a torsion spring of the device in accordance with the present teachings.

FIG. 7 shows one possible configuration of a torsion spring 21 said torsion spring being interspersed between barbell-shaped sections 11 by being similarly entrapped by the C-shaped retainers 9, 10, 13 and 14. The purpose to these torsion springs is to return the centre plate 6 back to its original position following a movement cycle wherein the centre plate 6 has been displaced as shown in FIG. 3.

Figure 8:
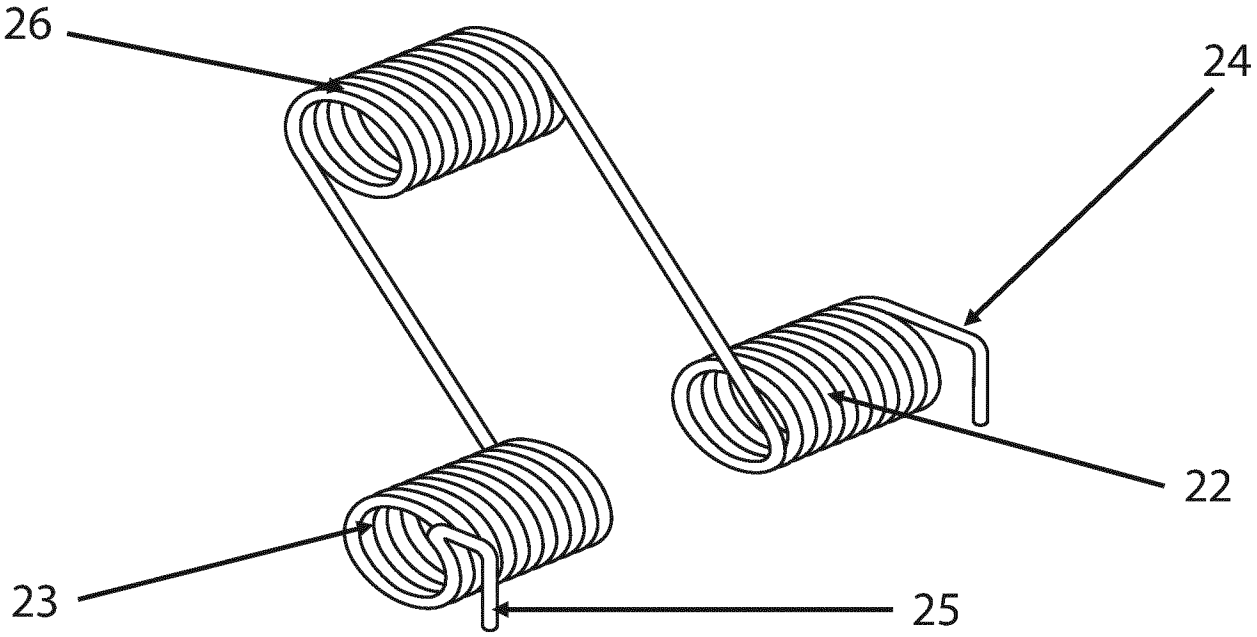
FIG. 8 shows also show the possible configuration of the torsion spring of FIG. 7.

FIG. 8 shows a drawing of one possible configuration of a suitable torsion spring 21 which is stressed in bending being rotated in angular deflection and offering resistance to externally applied torque whereby the coil diameter is reduced, and the body length increases as they are deflected. In this instance the device comprises two torque coils 22 and 23 and a further coil 26. These coils are slightly less than the inner diameter of the C-shaped retainers 9, 10, 13 and 14 formed respectively in the underside of the centre plate and lower frame. The coil 26 does not act under torque but simply serves to locate the spring within the C-shaped retainers. FIG. 8 also shows the ends 24 and 25 of the torsion springs which serve to both locate the spring over the upstands formed by the C-shaped retainers and provide resistance to spring rotation. These arms 24 and 25 also contribute to the lengthening of the spring sections under torque.

Figure 9:
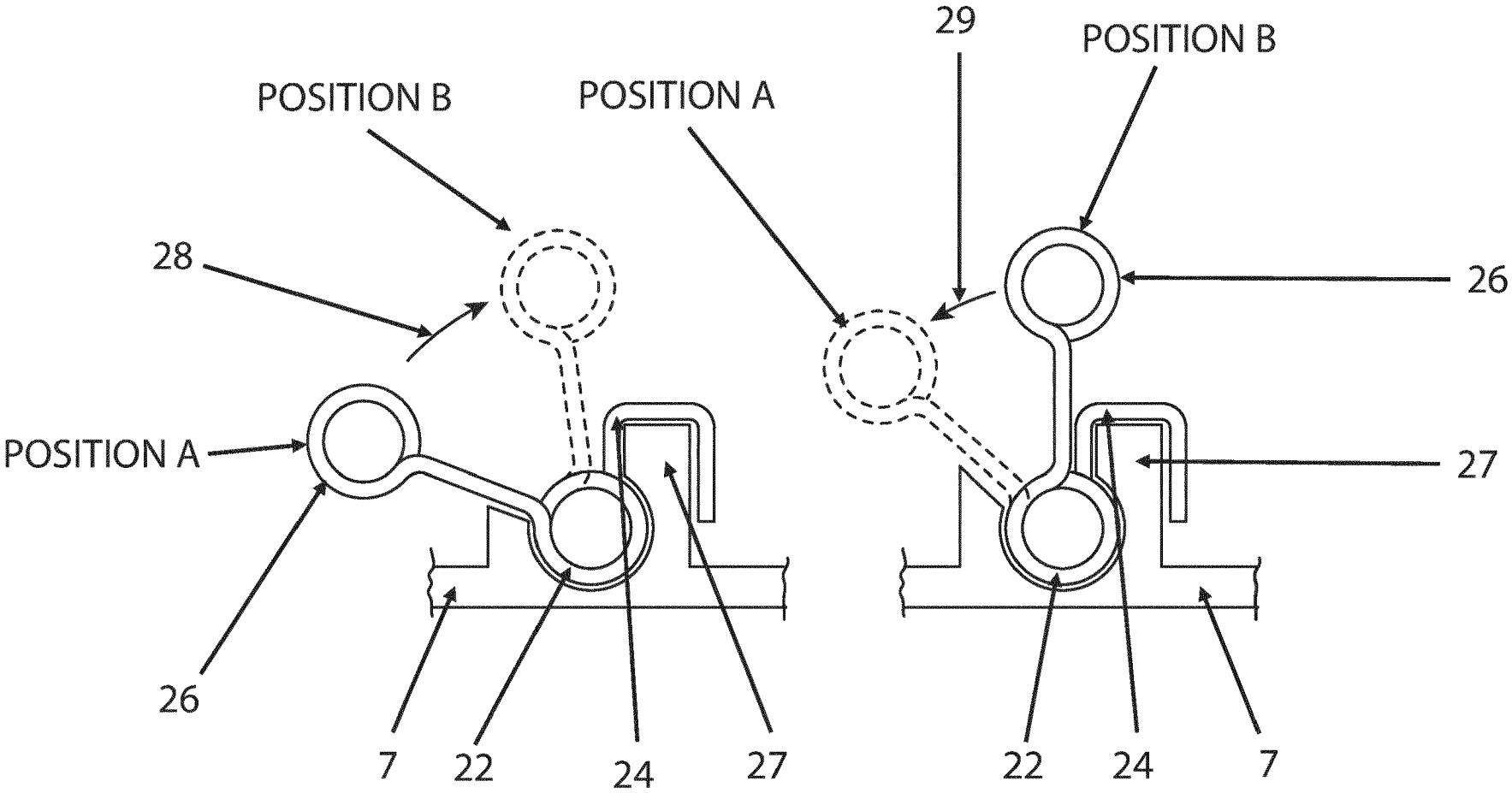
FIG. 9 shows the action of the torsion spring.

FIG. 9 shows the action of the torsion spring 21 described in FIG. 8 where the arms of the torsion spring 24 are held and loop over an upstand 27 on the lower frame. The torsion spring coil 22 is then rotated through externally applied torque in an angular deflection 28 moving the coil 26 from position A to position B. When the externally applied torque is removed the torsion coil 22 rotates back 29 to its original position wherein the coil 26 moves from position B to position A.

Figure 10:
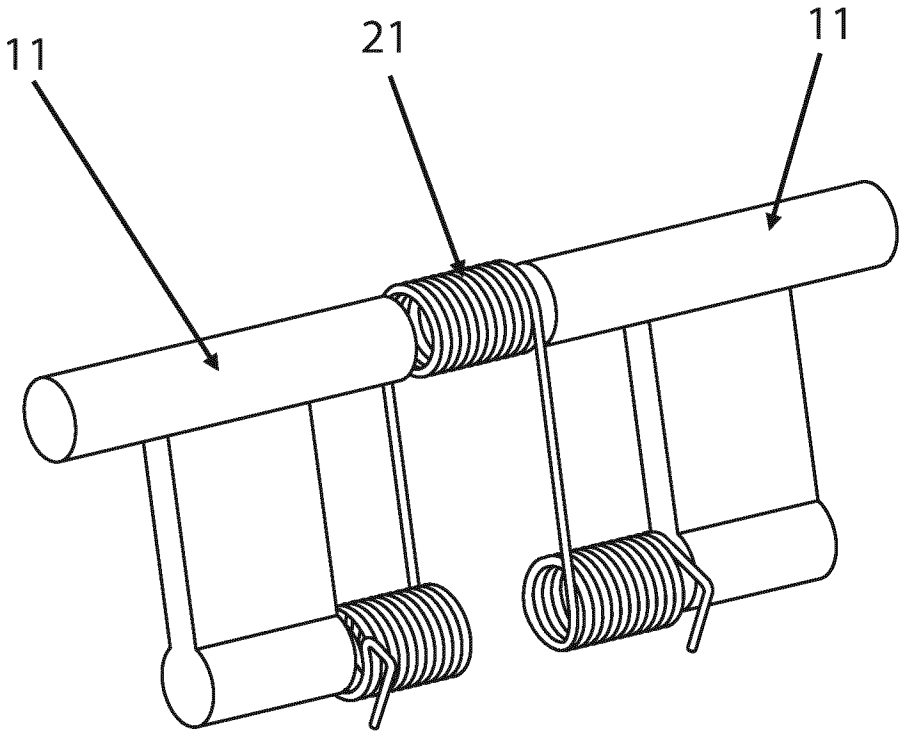
FIG. 10 shows one possible configuration of how barbell-shaped sections and torsion springs may be combined together for use in the device in accordance with the present teachings.

FIG. 10 shows an assembly of barbell shaped section 11 and torsion spring 21. That is, this is one possible configuration for inserting barbell shaped sections 11 and torsion spring 21 within the C-shaped retainers or connectors. The person skilled the art will appreciate that any combination of barbell shaped sections 11 and torsion springs 21 can be chosen.

Figure 11:
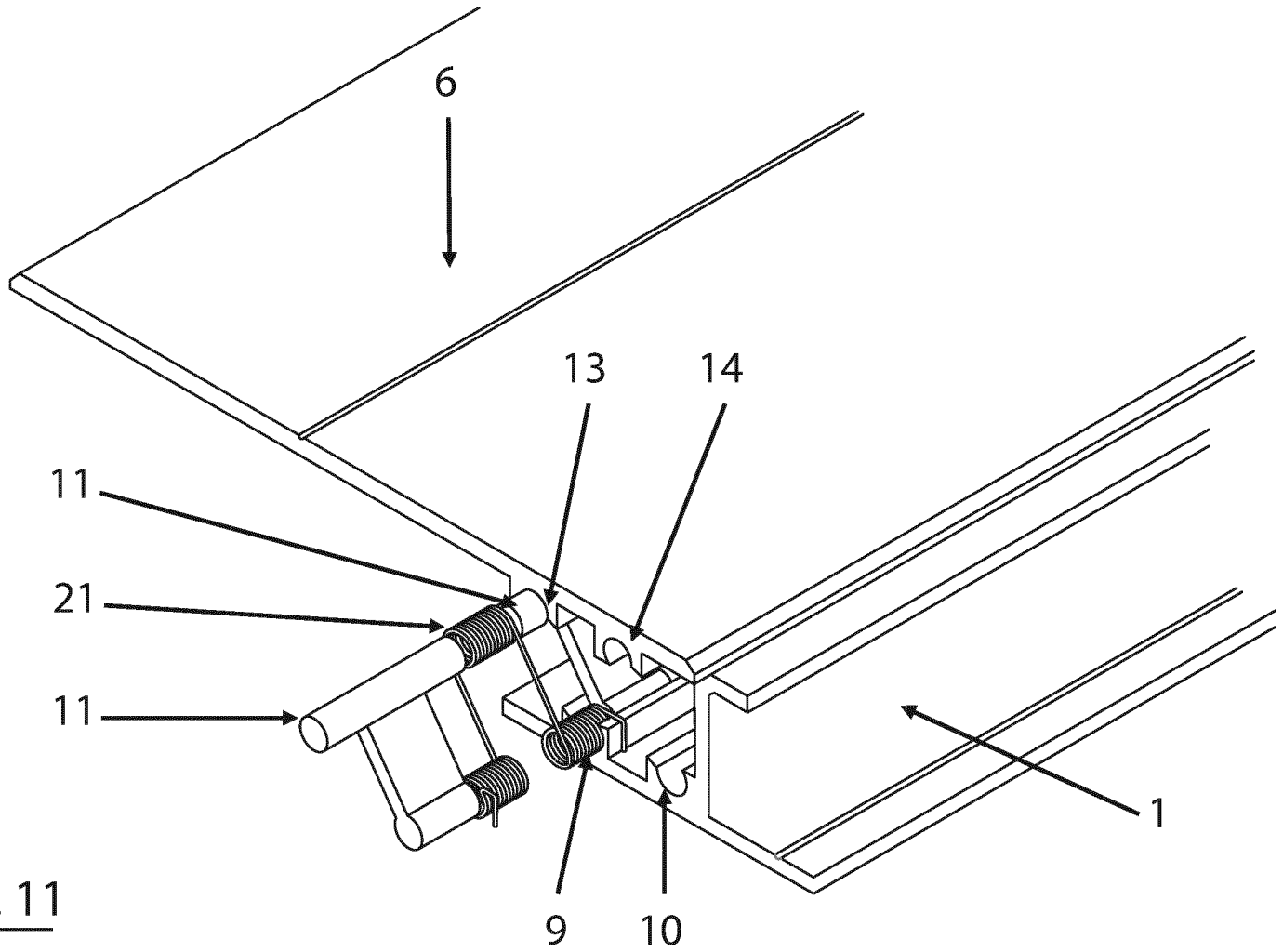
FIG. 11 shows how the barbell-shaped sections and torsion springs are fitted into one set of opposing C-shaped retainers in the centre plate and lower frame linking these two members together.

FIG. 11 shows a combination of barbell-shaped sections 11 and torsion springs 21 being installed in the C-shaped retainers 9 and 13. Optionally C-shaped retainers may contain only barbell-shaped sections 11 or torsion springs 21. Similarly, varying combinations of barbell-shaped sections 11 and torsion springs 21 may be installed in C-shaped retainers 10 and 14.

Figure 12:
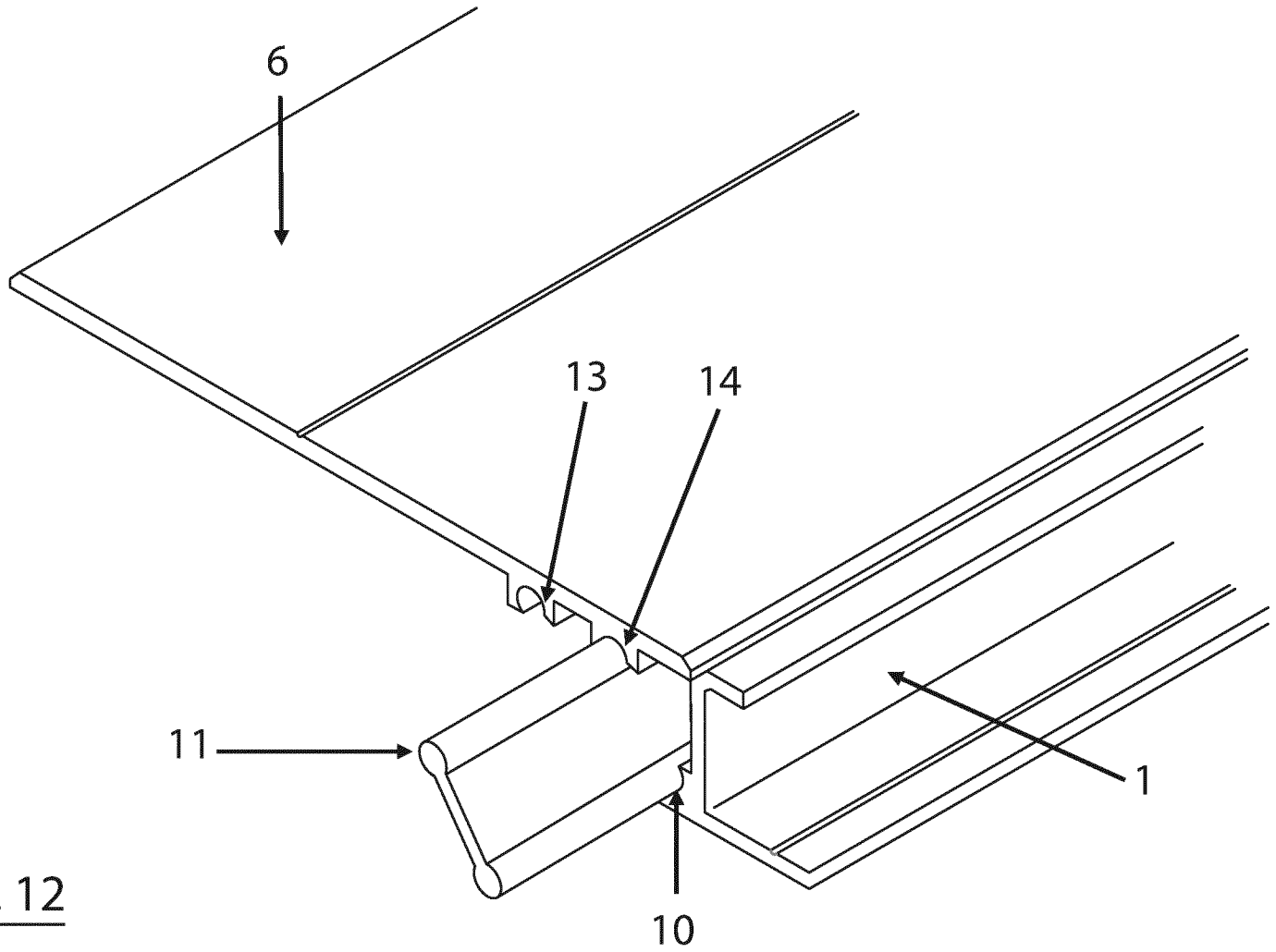
FIG. 12 shows how the barbell-shaped section may be fitted into the other set of opposing C-shaped retainers in the centre plate and lower frame linking these two members together.

FIG. 12 shows a continuous barbell-shaped section 11 and torsion being installed in the C-shaped retainers 10 and 14. In other iterations varying combinations of barbell-shaped sections 11 and torsion springs 21 may be installed in C-shaped retainers 10 and 14.

Figure 13:
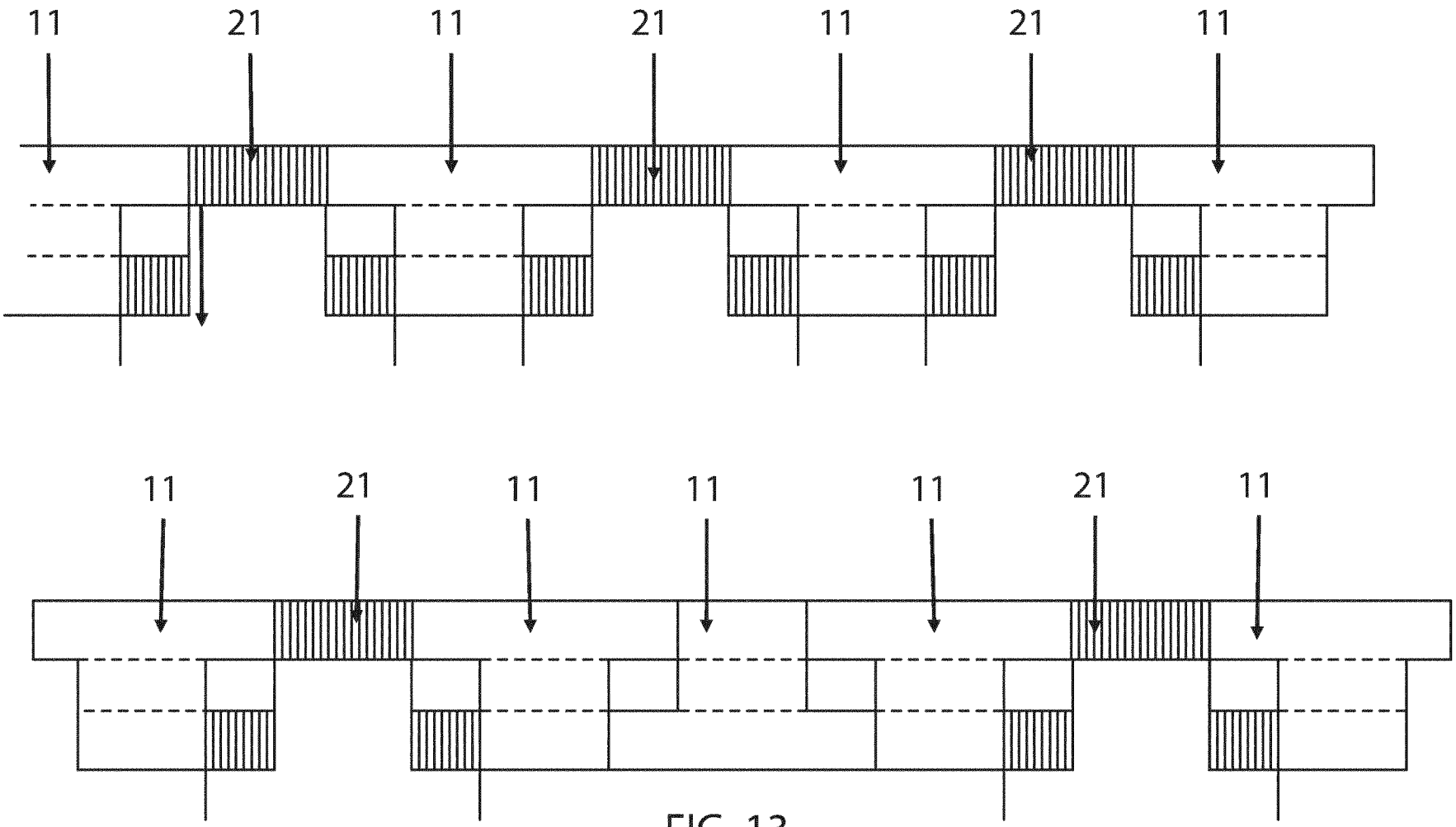
FIG. 13 shows a plan view of a series of differing configurations of barbell-shaped sections and torsion springs that can be used for the device in accordance with the present teachings.

FIG. 13 shows a plan view of a series of differing configurations of barbell-shaped sections 11 and torsion springs 21. The ratio of torsion springs 21 to barbell-shaped sections 11 along the length of a specified expansion joint cover assembly will determine the magnitude of torque required to force the centre plate (shown as 6 in FIGS. 1, 2, 3, 4, 5, 11 and 12) upwards. The greater the number of torsion springs the greater the force required to rotate the barbell-shaped sections 11 and 12.

This is an important aspect of the present teachings as it permits the device to be readily tailored to application. As noted earlier and shown in FIG. 3 when an expansion gap closes beyond its 'normal deflection' limit the leading edge 15 of the centre plate 6 meets the sloping upstand 5 of the opposite frame 1 and this centre plate 6 is forced upwards causing the barbell shaped sections 11 and 12 to rotate as shown in FIG. 3 thereby lifting the centre plate 6 whilst ensuring that it remains parallel with the plane of both the lower frame 7 and the opposite frame 1. Further closure of the expansion gap causes the upper plate 6 to extend beyond the end of the opposite plate 1 and across the surface of the finishes 16. When and if this movement is reversed the centre plate 6 should return to its original position. Otherwise it will create a trip hazard is installed in floors as well as allowing penetration of water and other contaminants if used in floors, walls and roofs.

When an expansion joint cover is installed in a floor, 'seismic movement' having initially caused the centre plate 6 to lift followed by the expansion gap 3 opening thereby potentially allowing the centre plate 6 to return to its original position the force of gravity may aid closure of the centre plate 6. Hence fewer torsion springs may be required to return the centre plate 6 to former position in expansion joint covers installed in floors when compared to joints installed in vertical and ceiling applications.

External expansion joint covers in walls and on roofs may be subjected to substantial wind loading and cannot rely upon the assistance of gravity to close the centre plate 6 to its original position. In this instance a larger number of torsion springs may be required than in the equivalent floor expansion joint cover.

Expansion joint covers affixed to cover expansion joints in ceilings cannot rely upon the assistance of gravity to close the centre plate 6 to its original position. In this instance a larger number of torsion springs may be required than in the equivalent floor expansion joint cover.

Hence a feature of this invention is its adaptability to the requirements of the location in which it is to be installed.

As previously mentioned, in alternative designs the device can incorporate hydraulic mechanisms as alternatives to torsion springs 21 said hydraulic mechanisms designed to force the centre plate 6 or pan-shaped section back to its original position following a movement cycle wherein the centre plate 6 or pan-shaped section has been displaced as shown in FIG. 3 and then returned to the position shown for example in FIG. 1, FIG. 2 or another position wherein the centre plate 6 returns to rest on the flat surface 4 of the opposing frame 1.

Another embodiment of the expansion joint cover is shown in FIGS. 14 to 18 inclusive wherein the centre plate 6 can comprise a pan-shaped section which can be infilled with finishes of varying types such as paving tiles, resins, coatings and wall cladding materials.

Figure 14:
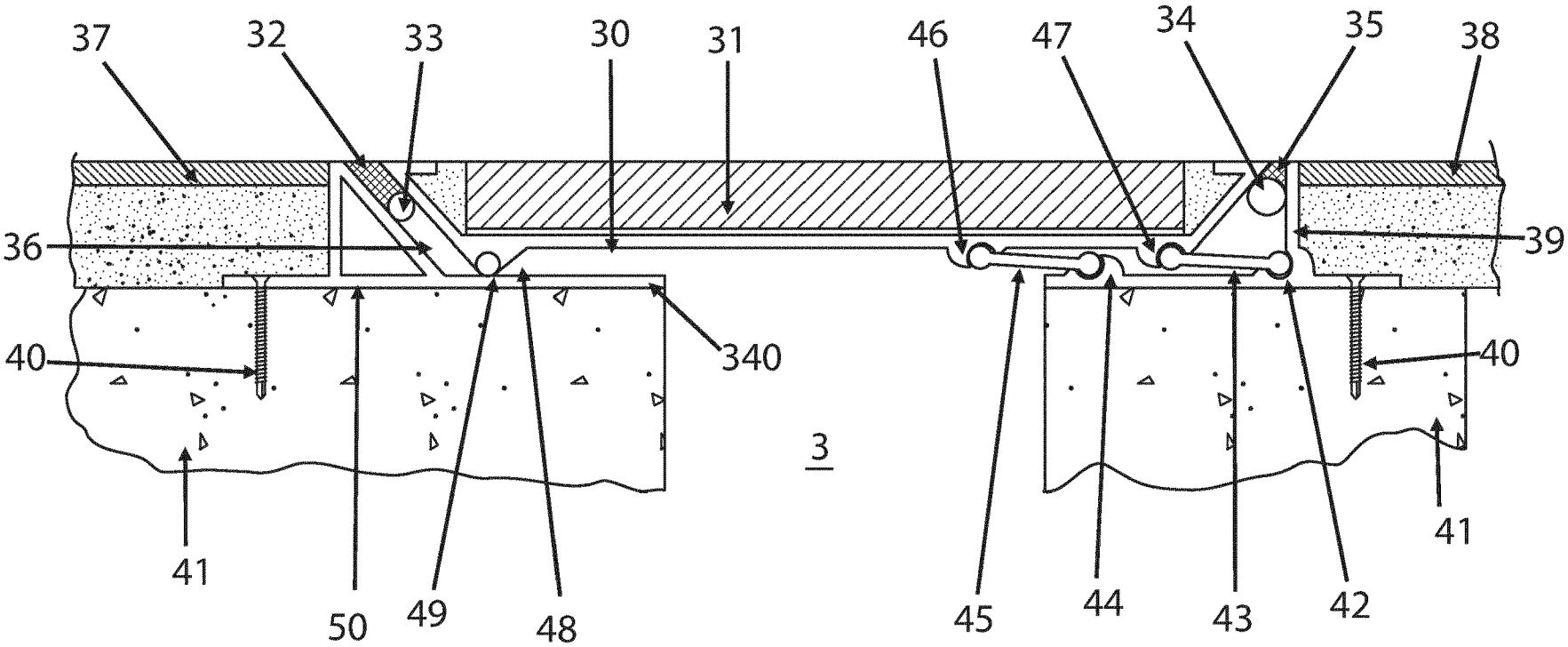
FIG. 14 shows a sectional view of another embodiment of the device labelled Type 2 wherein this device incorporates a central pan with sealant applied at either side of said pan instead of the Type 1 device where a centre plate is used.

FIG. 14 shows a sectional detail of a Type 2 device wherein the centre plate shown in FIGS. 1, 2, 3, 4, 5, 11 and 12 has been replaced by a pan system 30 into which an infill 31 such as paving, cladding or other materials may be installed. This both increases the load capacity and reduces the visual impact of the expansion joint cover. The pan 30 spans the expansion gap 3. In this form the device comprises a central pan 30 with outward sloping ends and a central recess for the installation of varying types of finish 31. The ends of the central pan 30 may alternatively extend at 90 degrees from the pan base. The expansion joint cover is fixed to the respective substrates 41 either side of the expansion gap 3 by means of screw or bolt fixings 40 and these fixings transfer movement forces within the structure to the expansion joint cover.

FIG. 14 shows a frame 50 fixed with said screws and bolts wherein the face of this frame that points inwards towards the expansion gap 3 slopes outwards. The outer face of the central pan 30 also slopes outwards such that the angles of both slopes are approximately the same.

FIG. 14 also shows an arm 48 that extends from the base of the pan 30 where this arm 48 entraps a roller mechanism or seal 49. The combination of the arm 48 and roller mechanism or seal 49 serve to both allow the device to move smoothly when the expansion gap 3 opens and closes and also allow an amount of vertical deflection between the levels of the substrate on one side of the expansion gap 3 to the substrate on the other side. The roller mechanism or seal 49 slides on a flat surface 340 of the frame 50.

FIG. 14 shows that a gap 36 has been left between the frame 50 and the sloping face of the central pan 30. This gap 36 can vary in width and is designed to accommodate 'normal deflections' of the structure such that it allows the expansion gap 3 to close until the outward sloping face of the central pan 30 touches the sloping face of the opposing frame 50.

In FIG. 14 the gap 36 incorporates a backer rod 33 made from a flexible material such as foam polyethylene topped by a sealant 32 which is used to accommodate movement and prevent the ingress of water, dirt and other contaminants. A further backer rod 34 and seam of sealant 35 is installed on the opposite side of the pan system for similar reasons.

In FIG. 14 the lower frame 39 is affixed to the substrate 41 by screws or bolts 40. This frame 39 having C-shaped retainers 42 and 44 into which barbell shaped sections 43 and 43 are inserted said barbell-shaped sections 43 and 45 incorporating torsion springs or hydraulic mechanisms and these being further attached by C-shaped retainers 46 and 47 to the central pan 30. The C-shaped retainers 42, 44, 46 and 47 being designed to entrap the ends of the barbell shaped sections 43 and 45 whilst at the same time allowing them to rotate in response to pressure on the sloping outer faces of the central pan 30 by the sloping face of the opposing frame 50 when the expansion gap 3 closes sufficiently.

Figure 15:
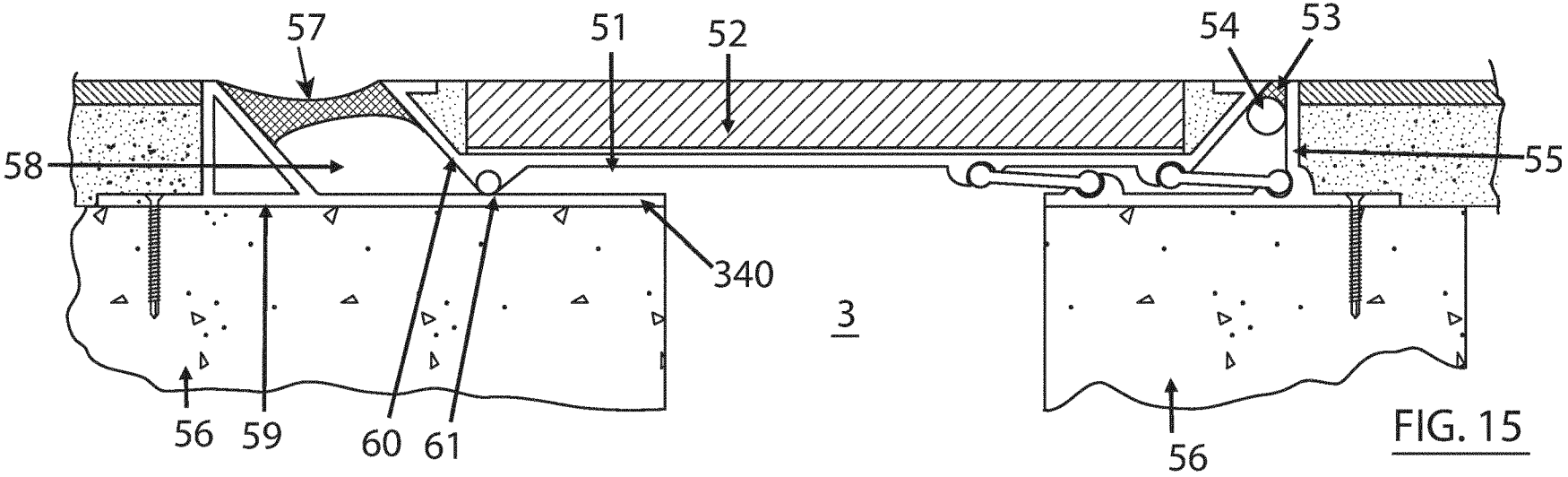
FIG. 15 shows a sectional view of the Type 2 device which incorporates a central pan with sealant applied at either side of said pan after 'normal deflection' has caused the expansion gap to open and the sealant to be stretched.

FIG. 15 is a sectional view of the Type 2 device after the expansion gap 3 has opened in response to 'normal deflection' where the substrates 56 withdraw and either frame 59 thereby increasing width of the expansion gap 3. The width of the central pan 51 may be tailored to accommodate the maximum expected opening movement of the expansion gap 3 whether such movement arises from 'normal deflection' or 'seismic deflection. In FIG. 15 it may be seen that the gap 58 between the outer frame 59 and the pan 51 has opened in response to the 'normal deflection' such that the seam of sealant 57 has been stretched.

Figure 16:
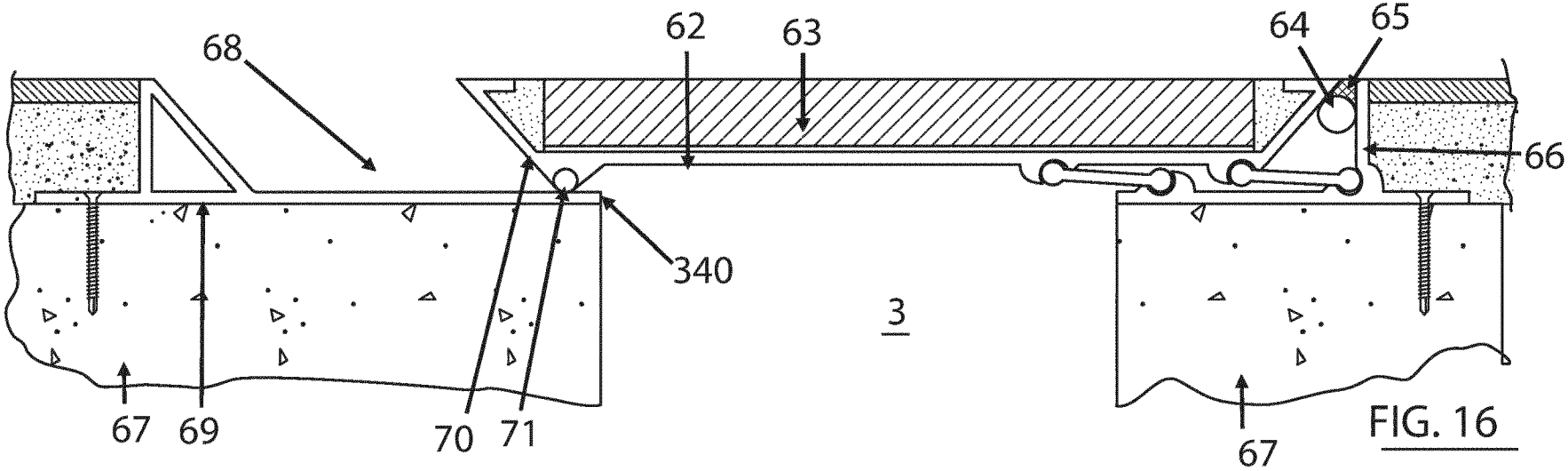
FIG. 16 shows a sectional view of the Type 2 device which incorporates a central pan which previously had sealant applied at either side of said pan after 'seismic deflection' has caused the expansion gap to open.

FIG. 16 displays the Type 2 device following 'seismic deflection' wherein the expansion gap 3 has opened to its full extent and the central pan 62 has withdrawn opening a gap 68 between the face 70 of the central pan and the outer frame 69. This smooth operation of this action is aided by the roller/seal 71 sliding on the flat surface 340. In this instance the seam of sealant that had been inserted between the central pan 62 and the outer frame 69 is sacrificial has failed and, as a consequence has been eliminated from this drawing. The seam of sealant 65 and foam backer rod 64 remain in place.

Figure 17:
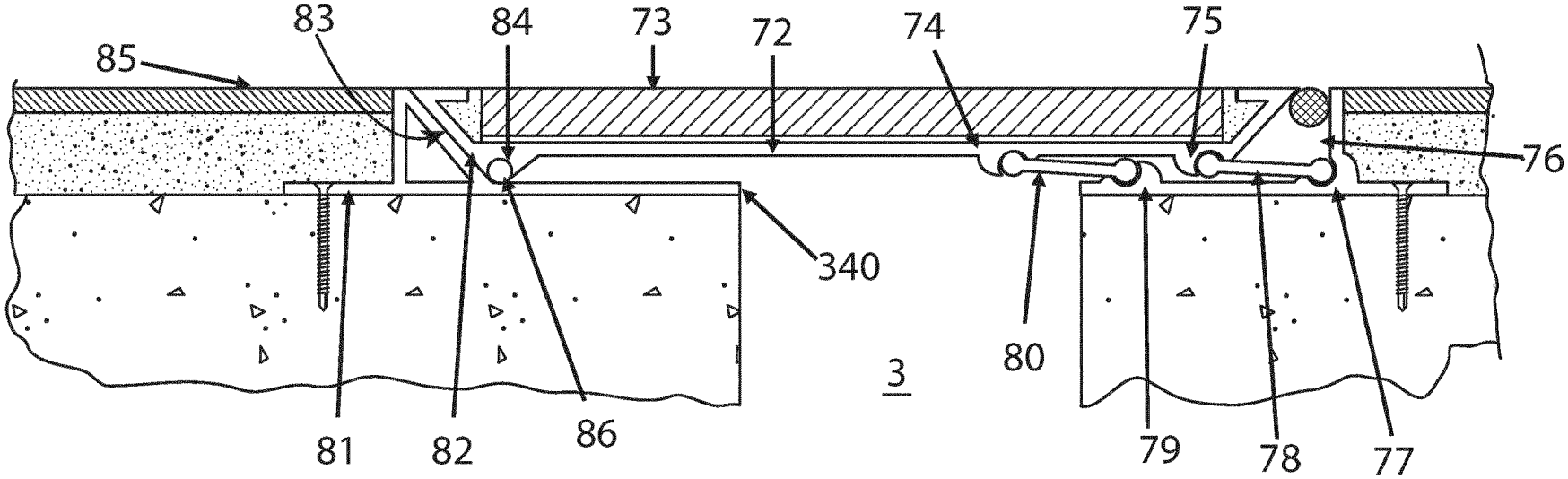
FIG. 17 shows a sectional view of the Type 2 device which incorporates a central pan which previously sealant applied at either side of said pan after 'normal deflection' has caused the expansion gap to close.

FIG. 17 depicts a situation where the expansion gap 3 has closed in response to 'normal deflection' movement and the sloping face of the central pan 83 meets the sloping face 82 of the central pan 72. This closure has forced the sealant and backer rod from the space between the central pan and the outer frame. In this instance the sealant has been ejected from the gap between the frames and has been omitted from the figure.

Figure 18:
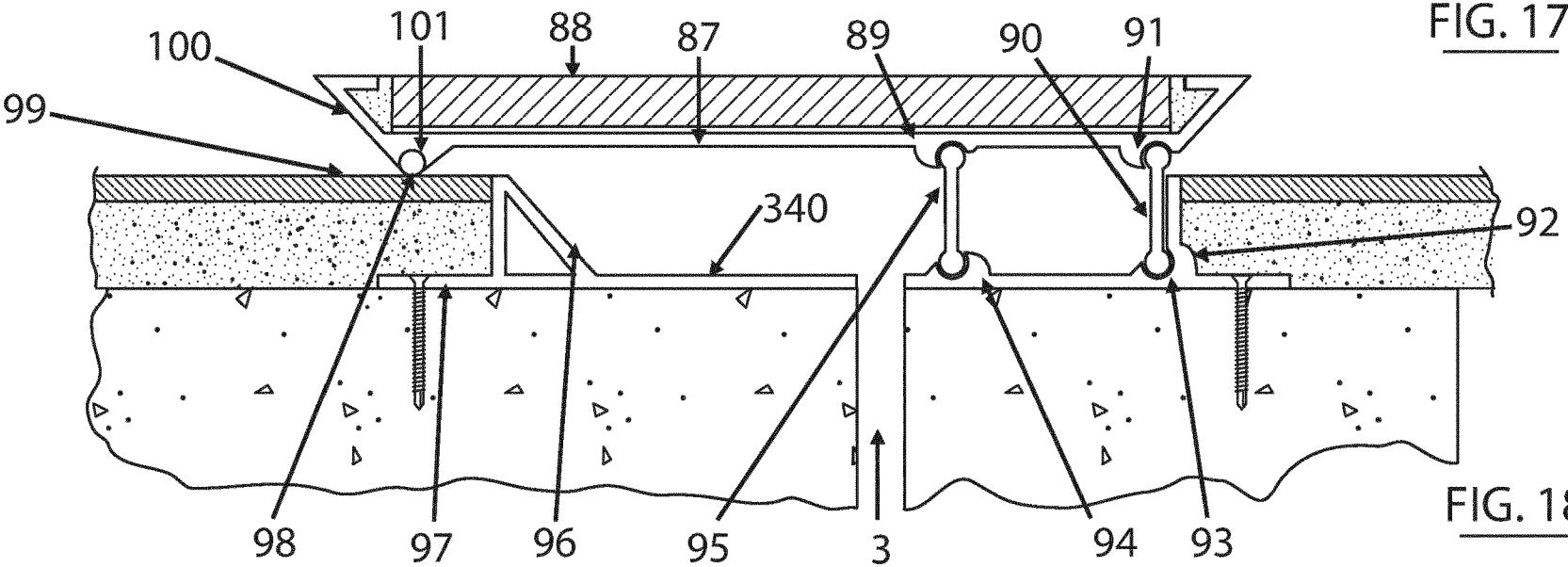
FIG. 18 shows a sectional view of the Type 2 device following 'seismic deflection' wherein the central pan has been forced upwards and as the sealant has failed.

FIG. 18 depicts the Type 2 expansion joint cover in a situation where the expansion gap 3 has closed in response to 'seismic deflection' movement to an extent greater than 'normal deflection' such as during a earthquake wherein the sloping face 100 of the central pan 87 comes into contact with the sloping face 96 of the opposing frame 97 and the central pan 87 is forced upwards causing the barbell shaped sections 90 and 95 to rotate upwards thereby lifting the central pan 87 whilst ensuring that it remains parallel with the plane of both the lower frame 92 and the opposite frame 97. Further closure of the expansion gap 3 causes the central pan 87 to extend over and beyond the top of the opposing frame 97 and across the surface of the abutting substrate 99. This smooth operation of this action is aided by the roller/seal 98 which is fitted within an extension 101 of the central pan 87. In this type of seismic deflection event the seams of sealant and backer rods which had been inserted either side of the central pan 87 are sacrificial have failed and have been eliminated from this drawing.

Another embodiment of the expansion joint cover in accordance with the present teachings is shown in FIGS. 19 to 23. This embodiment is similar to the Type 2 device except that a different configuration is provided for the seals used between each section of the frame and the centre pan.

Figure 19:
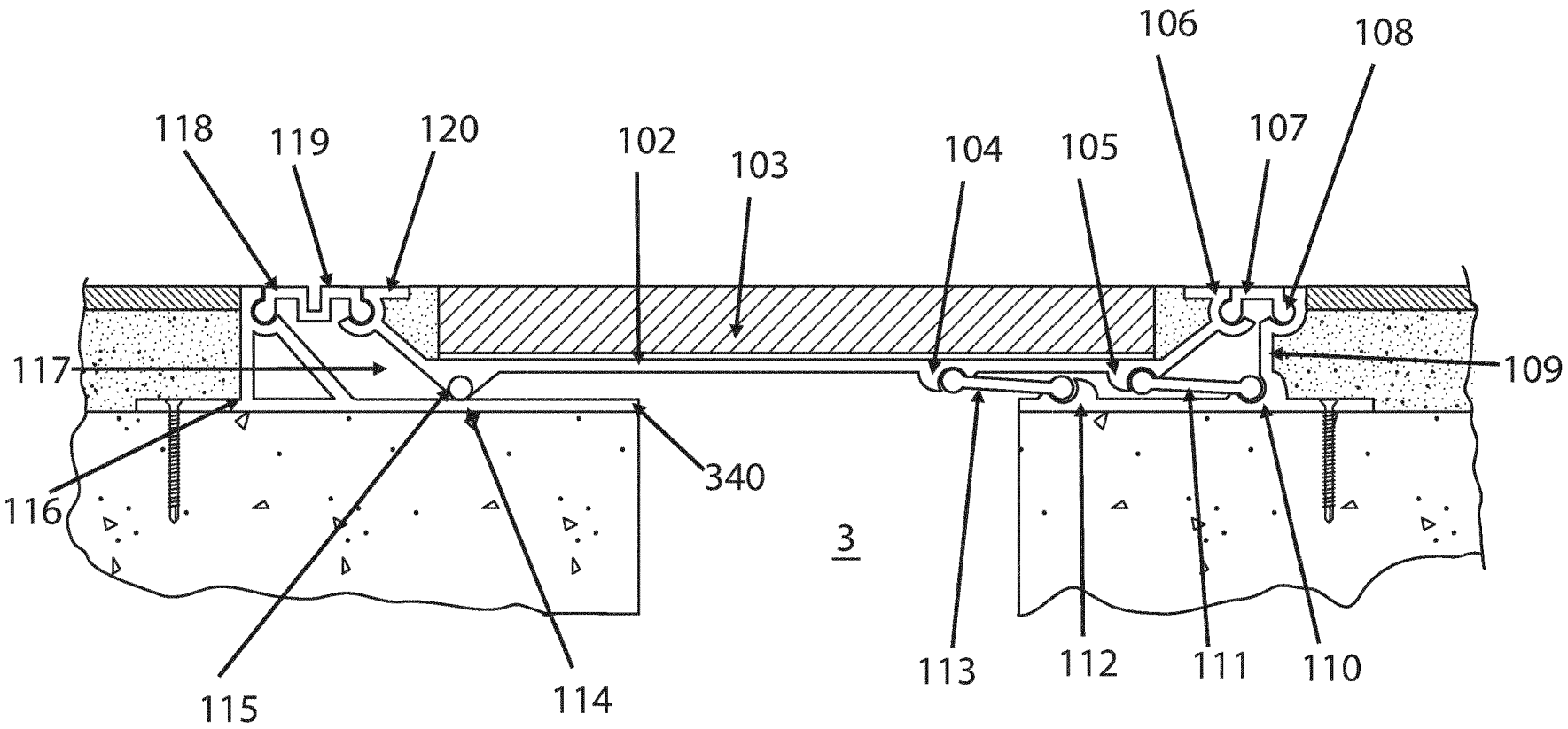
FIG. 19 shows a sectional view of another embodiment of the present invention labelled Type 3 device which incorporates a central pan with pre-extruded elastomeric seals applied at either side of said pan.

FIG. 19 shows a sectional detail of the Type 3 device wherein the centre plate shown in FIGS. 1, 2, 3, 4 and 5 has been replaced by a pan system 102 into which an infill 103 such as paving, cladding or other materials may be installed. This allows an increase in the load capacity and reduces the visual impact of the expansion joint cover. The pan 102 spans the expansion gap 3. In this form the device comprises a central pan 102 with outward sloping ends said ends having recesses 106 and 120 which are designed to engage with pre-extruded flexible seals 119 and 107. The ends of the central pan 102 may alternatively extend at 90 degrees from the pan base. The expansion joint cover is fixed to the respective substrates by means of screw or bolt fixings and these fixings transfer movement forces within the structure to the expansion joint cover.

FIG. 19 shows an outer frame 116 fixed with said screws and bolts wherein the lower face of this frame 116 points inwards towards the expansion gap 3 and thereafter slopes outwards having a recess 118 at the uppermost point of the frame 116 wherein this recess is used to entrap the ends of a pre-extruded seal 119. The outer face of the central pan 102 also slopes outwards such that the angles of both slopes are approximately the same.

FIG. 19 also shows an arm 115 that extends from the base of the pan 102 where this arm 115 entraps a roller mechanism or seal 114. The combination of the arm 115 and roller mechanism 114 serve to both allow the device to move smoothly on the flat surface 340 of the frame when the expansion gap 3 opens and closes and also allow an amount of vertical deflection between the level of the substrate on one side of the expansion gap 3 to the substrate on the other side.

FIG. 19 shows that a gap 117 has been left between the frame 116 and the sloping face of the central pan 102. This gap 117 can vary in width and is designed to accommodate 'normal deflections' of the structure such that it allows the expansion gap 3 to close until the outward sloping face of the central pan 102 touches the sloping face of the opposing frame 116. This closing movement serves to accommodate deflections arising from 'normal deflection' forces.

In FIG. 19 the gap 46 is closed at the surface by means of a seal 119 the ends of which are inserted into the recess 118 of the outer frame 116 and on the other side of the gap 117 the ends of the seal are fitted into the recess 120 of the central pan 102. A further seal 107 is installed on the opposite side of the pan system 102 wherein the ends of this seal 107 are inserted into the recess 108 of the lower frame 109 and the recess 106 of the central pan 102.

In FIG. 19 the lower frame 109 is affixed to the substrate by screws or bolts this frame 109 having C-shaped retainers 110 and 112 into which barbell shaped sections 111 and 113 are inserted said barbell-shaped sections 111 and 113 incorporating torsion springs or hydraulic mechanisms and these being further attached by C-shaped retainers 104 and 105 to the central pan 102. The C-shaped retainers 110, 112, 104 and 105 being designed to entrap the ends of the barbell shaped sections 111 and 113 whilst at the same time allowing them to rotate in response to pressure on the sloping outer faces of the central pan 102 by the sloping face of the outer frame 116 when the expansion gap 3 closes sufficiently.

Figure 20:
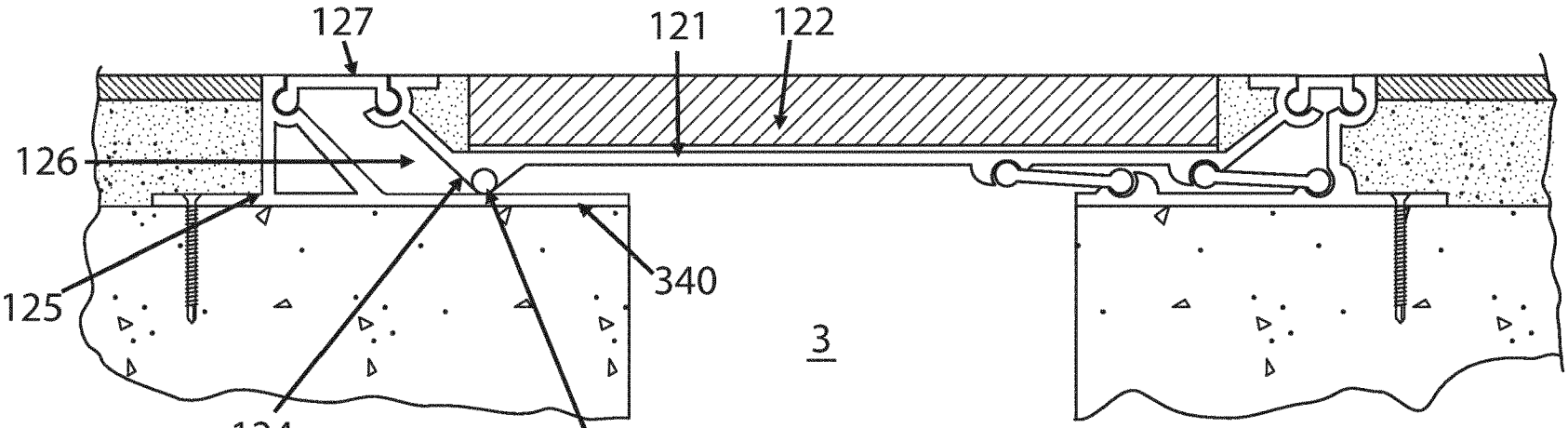
FIG. 20 shows a sectional view of the Type 3 device which incorporates a central pan with pre-extruded elastomeric seals applied at either side of said pan after 'normal deflection' has caused the expansion gap to open.

FIG. 20 is a sectional view of the Type 3 device after the expansion gap 3 has opened in response to 'normal deflection'. In this figure the gap 126 between the outer frame 125 and the central pan 121 has opened by a similar amount to that of the expansion gap 3 such that the seal 127 has been stretched to accommodate the movement. The width of the central pan 121 may be tailored to accommodate the maximum expected opening movement of the expansion gap 3 whether such movement arises from 'normal deflection' or 'seismic deflection'. In this instance one of the pre-extruded elastomeric seals has been stretched.

Figure 21:
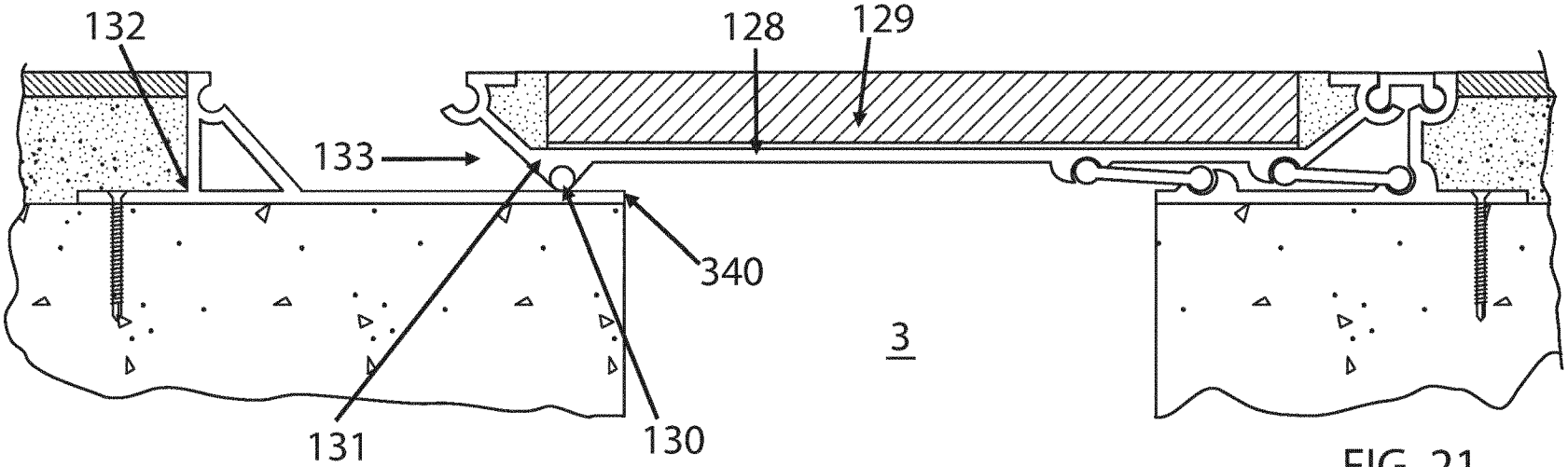
FIG. 21 shows a sectional view of the Type 3 device which incorporates a central pan which formerly had pre-extruded elastomeric seals applied at either side of said pan after 'seismic deflection' has caused the expansion gap to open.

FIG. 21 is a sectional view of the Type 3 device after the expansion gap 3 has opened in response to 'seismic deflection'. In this figure the gap 133 between the outer frame 132 and the central pan 128 has opened to such an extent that the pre-extruded flexible seal that was fitted between the outer frame 132 and the central pan 128 has failed and hence has been omitted from this drawing.

Figure 22:
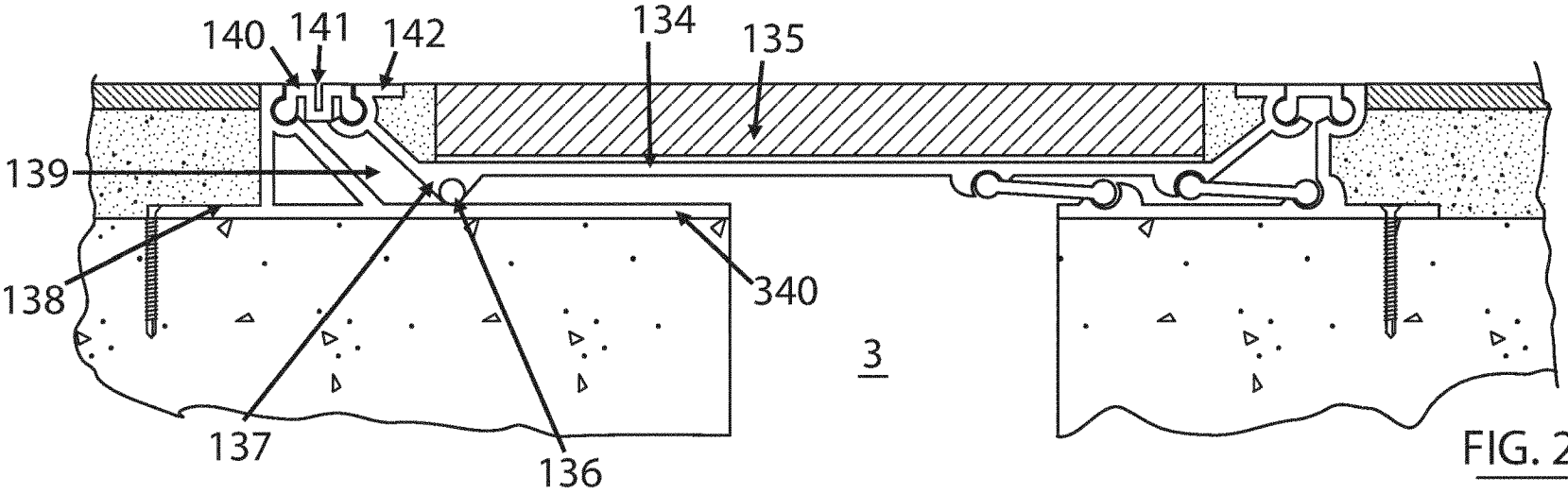
FIG. 22 shows a sectional view of the Type 3 device which incorporates a central pan with pre-extruded elastomeric seals applied at either side of said pan after 'normal deflection' has caused the expansion gap to close and the pre-extruded seal on one side of the expansion joint cover has been compressed.

FIG. 22 show the Type 3 invention in a situation where the expansion gap 3 has closed in response to 'normal deflection' and where the gap 139 has similarly closed in response to such movement resulting compression of the seal 141.

Figure 23:
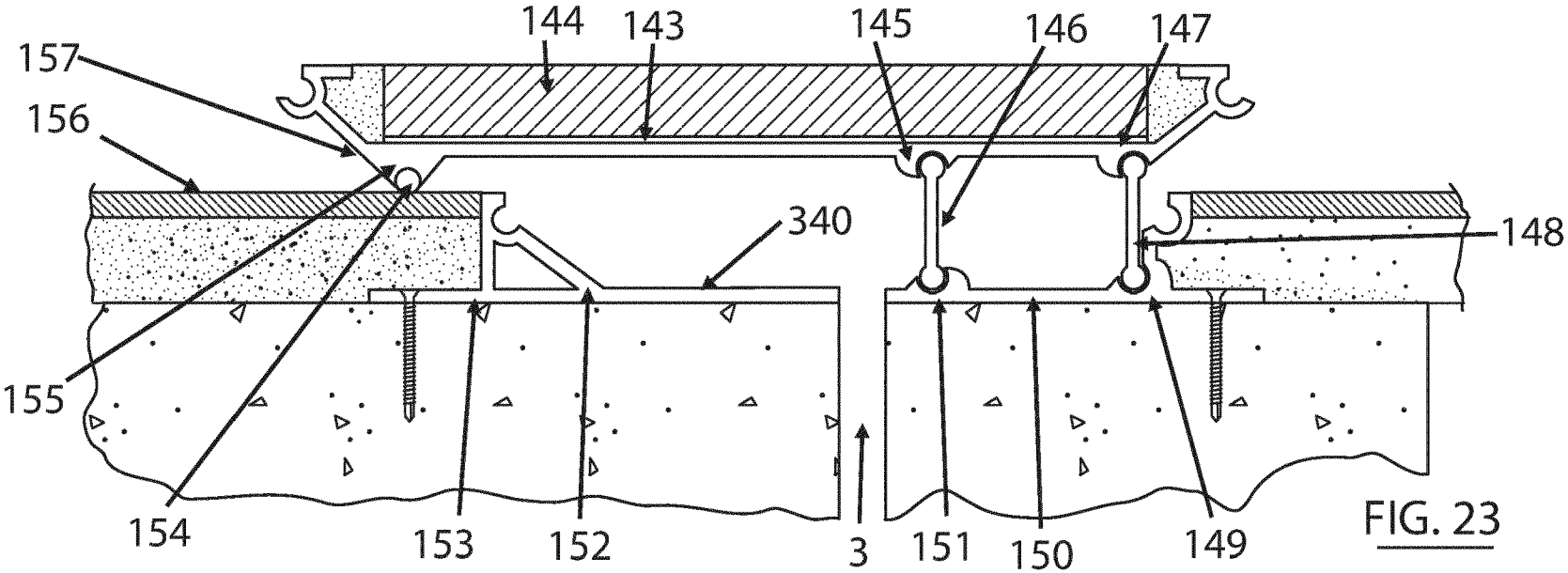
FIG. 23 shows a sectional view of the Type 3 device which incorporates a central pan which formerly had pre-extruded elastomeric seals applied at either side of said pan after 'seismic deflection' has caused the expansion gap to close.

FIG. 23 depicts the Type 3 invention in a situation where the expansion gap 3 has closed in response to 'seismic deflection' to an extent greater than 'normal deflection' such as during an earthquake wherein the sloping face 157 of the central pan 143 comes into contact with the sloping face 152 of the outer frame 153 and the central pan 143 is forced upwards causing the barbell shaped sections 146 and 148 to rotate as shown upwards thereby lifting the central pan 143 whilst ensuring that it remains parallel with the base plane of both the lower frame 149 and the outer frame 153. Further closure of the expansion gap 3 causes the central pan 143 to extend over and beyond the top of the opposing frame 153 and across the surface of the abutting substrate 156. The seals which were installed on either side of the central pan 143 are sacrificial, have failed and are omitted from this drawing.

Another embodiment of the expansion joint cover in accordance with the present teachings is shown in FIGS. 19 to 23. This embodiment is similar to the Type 2 and Type 3 devices except that instead of seals, wings or flange are connected to the centre pan and these contact the frame at each side of the centre pan.

Figure 24:
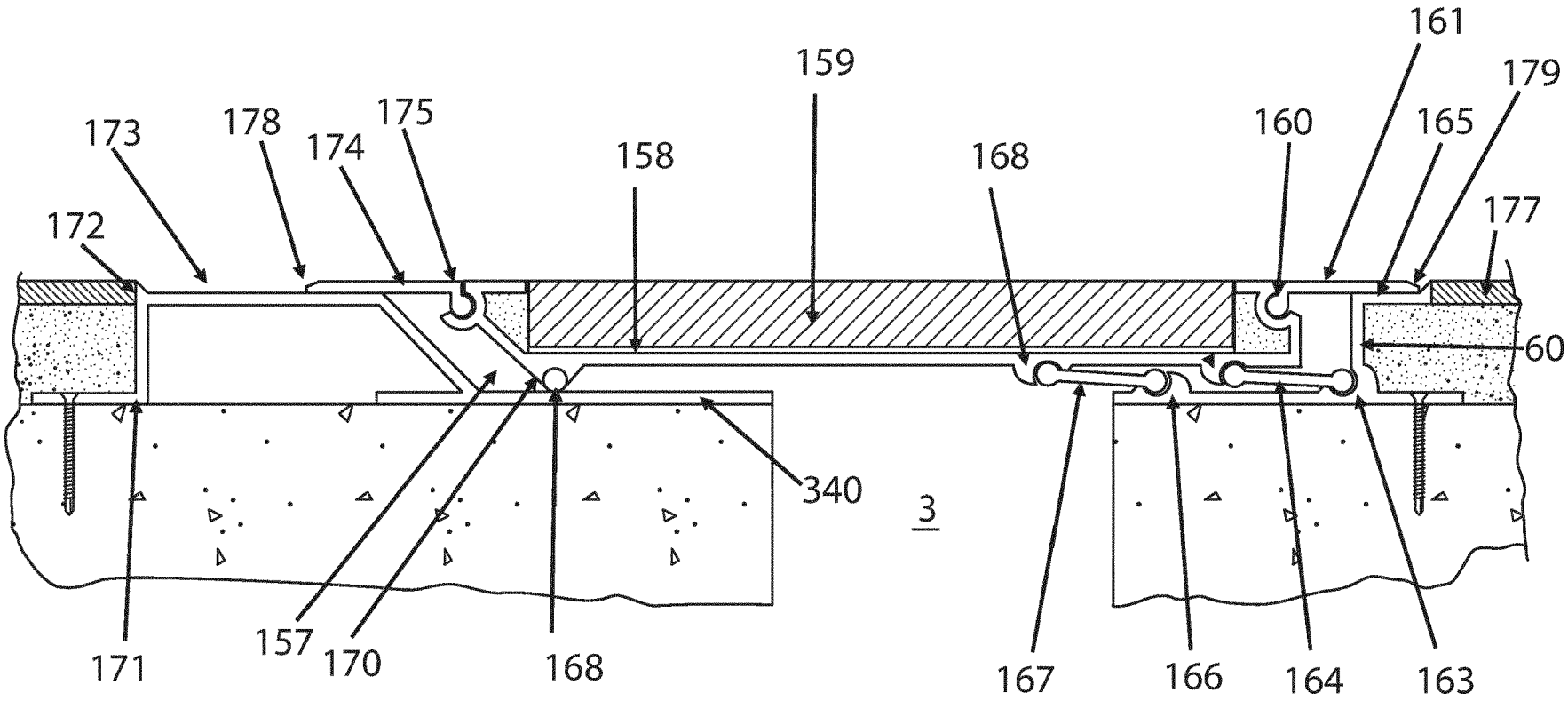
FIG. 24 shows a sectional view of another embodiment of the present teachings labelled Type 4 device which incorporates a central pan with preferentially metal flanges or wings installed either side of said pan.

FIG. 24 shows a sectional detail of a Type 4 device wherein the centre plate shown in FIGS. 1, 2, 3, 4 and 5 has been replaced by a pan system 158 into which an infill 159 such as paving, cladding or other materials may be installed. The pan 158 spans the expansion gap 3. In this form the device comprises a central pan 158 with one outward sloping end 170 said end having a recess 175 into which a flange or wing section 174 is installed. At the other end of the central pan 158 a similar recess 160 has been formed in the end of the section said recess being used for the installation of a flange or wing 161.

In FIG. 24 the gap 157 is closed at the surface by means of a preferably metal or rigid plastic arm 174 wherein this section spans the gap 157 such that it overhangs the flat surface 178 of the outer frame 171. The end of the arm 174 is engaged in the recess 175 such that is forms a hinge which is described in greater detail in FIG. 20. At the other end of the central pan 158 a further hinged metal or rigid plastic arm 161 is installed within the recess 160 of the central pan 52 wherein this section spans the flat upper part of the lower frame 162.

The sloped end 170 of the central pan 158 may alternatively extend at 90 degrees from the pan base. The expansion joint cover is fixed to the respective substrates by means of screw or bolt fixings and these fixings transfer movement forces within the structure to the expansion joint cover.

FIG. 24 shows an outer frame 171 fixed with said screws and bolts wherein the lower face of this frame 171 points inwards towards the expansion gap 3 and thereafter slopes outwards. The top surface 173 of this frame 171 is substantially flat except for a sloping upstand 172 at the end of the section. The outer face 170 of the central pan 158 also slopes outwards such that the angles of both slopes are approximately the same.

FIG. 24 also shows an arm that extends from the base of the pan 158 where this arm entraps a roller mechanism or seal 168. Again, this slides on a flat surface 340 of the frame. The combination of the arm and roller mechanism 168 serve to both allow the device to move smoothly when the expansion gap 3 opens and closes and also allow an amount of vertical deflection between the level of the substrate on one side of the expansion gap 3 to the substrate on the other side.

FIG. 24 shows that a gap 157 has been left between the outer frame 171 and the sloping face of the central pan 158. This gap 157 can vary in width and is designed to accommodate 'normal deflections' of the structure such that it allows the expansion gap 3 to close until the outward sloping face of the central pan 158 touches the sloping face of the outer frame 171. The dimensions of the gap 157 are normally mirrored by the distance between the end 178 of the flange or wing 174 and the beginning of the upstand 172 of the outer frame 171. These equal dimensions allow closing movement which serves to accommodate deflections arising from 'normal deflection' forces.

Figure 25:
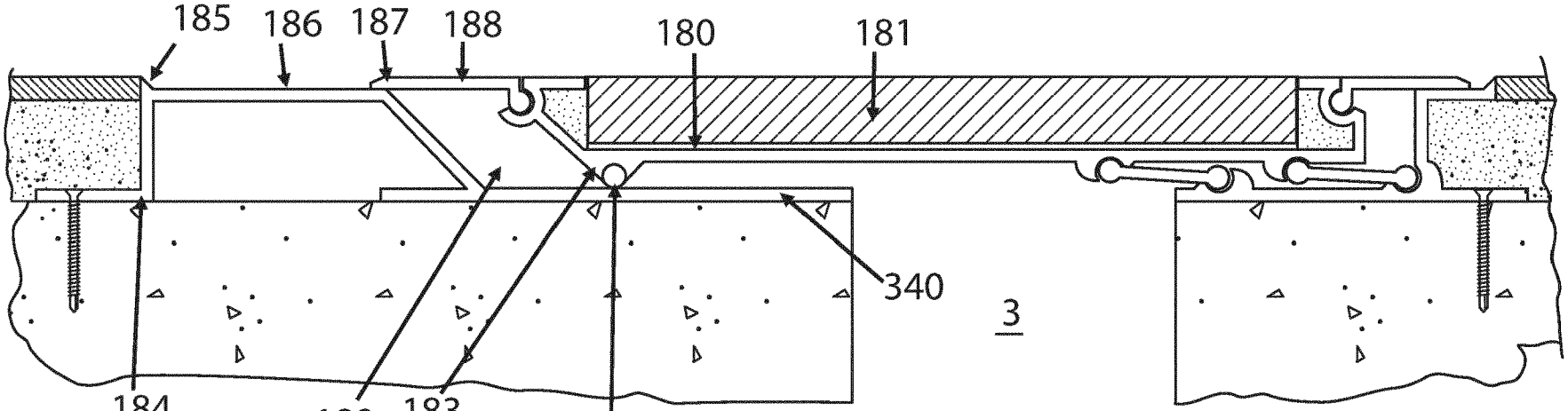
FIG. 25 shows a sectional view of the Type 4 device which incorporates a central pan with preferentially metal flanges or wings installed at either side of said pan after 'normal deflection' has caused the expansion gap to open.

FIG. 25 is a sectional view of the Type 4 device after the expansion gap 3 has opened in response to 'normal deflection'. In this figure the gap 189 between the outer frame 184 and the central pan 180 has opened by a similar amount to that of the expansion gap 3 such that the flange or wing 188 has been withdrawn across the flat upper surface 186 of the outer frame 184 to accommodate the movement. The width of the central pan 180 and the flange or wing 188 may be tailored to accommodate the maximum expected opening movement of the expansion gap 3 whether such movement arises from 'normal deflection' or 'seismic deflection'.

Figure 26:
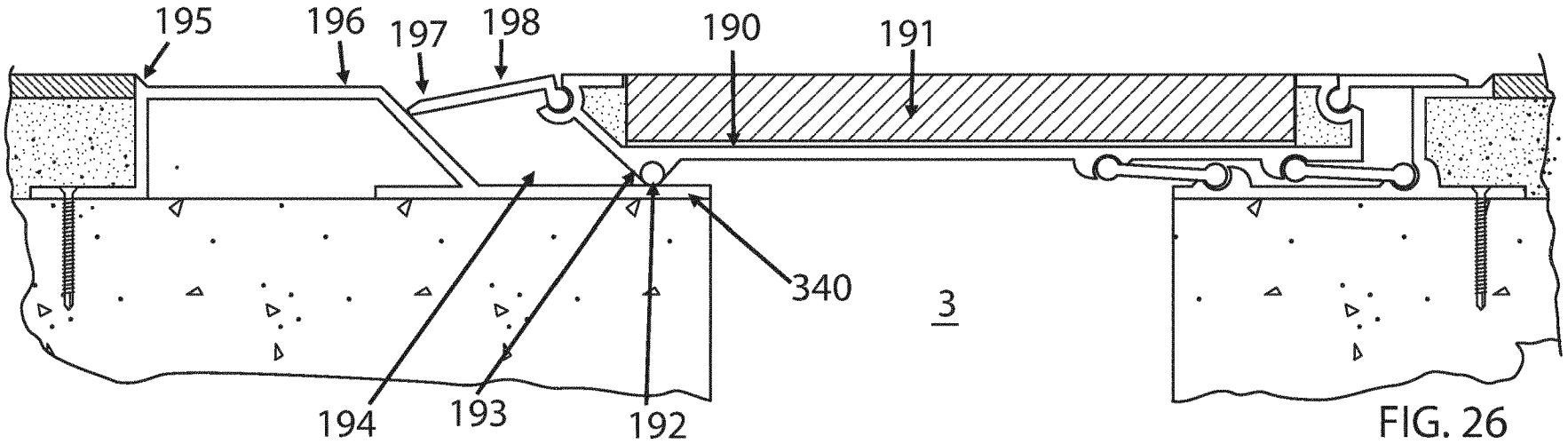
FIG. 26 shows a sectional view of a Type 4 device which incorporates a central pan with preferentially metal flanges or wings installed at either side of said pan after 'seismic deflection' has caused the expansion gap to open.

FIG. 26 represents the Type 4 device after the expansion gap 3 has opened in response to 'seismic deflection'. In this figure the gap 194 between the outer frame 184 and the central pan 190 has opened by a similar amount to that of the expansion gap 3 such that the flange or wing 198 has been withdrawn across the flat upper surface 196 of the outer frame 195 to accommodate the movement. In this situation the end 197 of the flange or wing 198 can rotate downwards until it touches the sloping face of the outer frame 195. The width of the central pan 190 and the flange or wing 198 may be tailored to accommodate the maximum expected opening movement of the expansion gap 3 whether such movement arises from 'normal deflection' or 'seismic deflection'.

Figure 27:
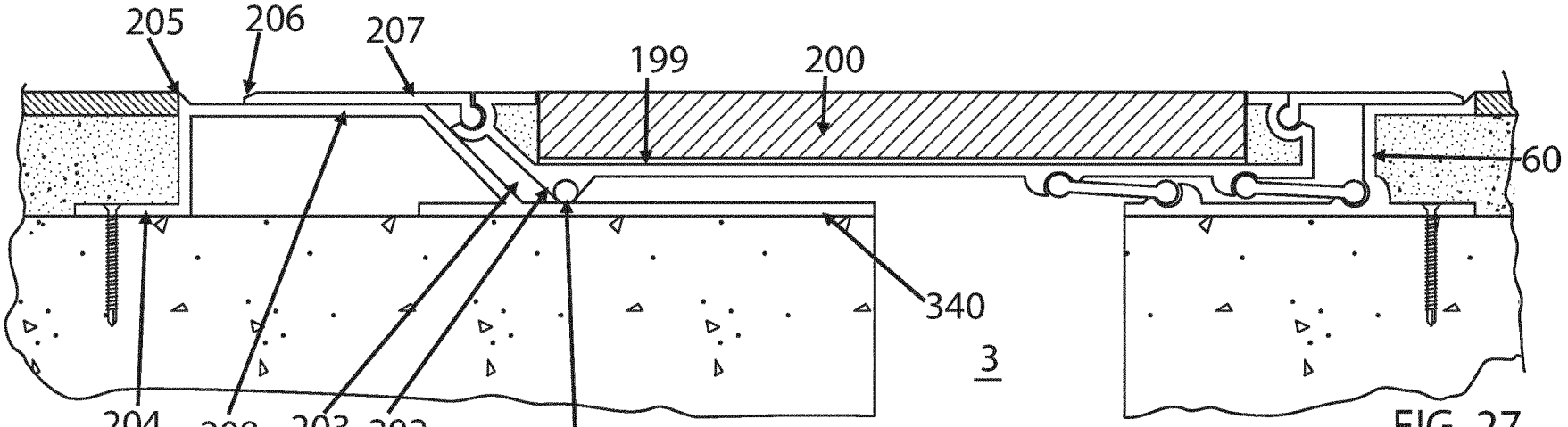
FIG. 27 shows a sectional view of the Type 4 device which incorporates a central pan with preferentially metal flanges or wings installed applied at either side of said pan after 'normal deflection' has caused the expansion gap to close.

FIG. 27 is a sectional view of the Type 4 device after the expansion gap 3 has closed in response to 'normal deflection. In this figure the gap 203 between the outer frame 204 and the outer face of the central pan 199 has closed by a similar amount to that of the expansion gap 3 such that the flange or wing 207 has been moved across the flat surface 208 of the outer frame 204 until it touches the sloping edge 205 of the outer frame 204. The width of the central pan 199 and flange or wing 207 may be tailored to accommodate the maximum expected opening movement of the expansion gap 3 whether such movement arises from 'normal deflection' or 'seismic deflection.

Figure 28:
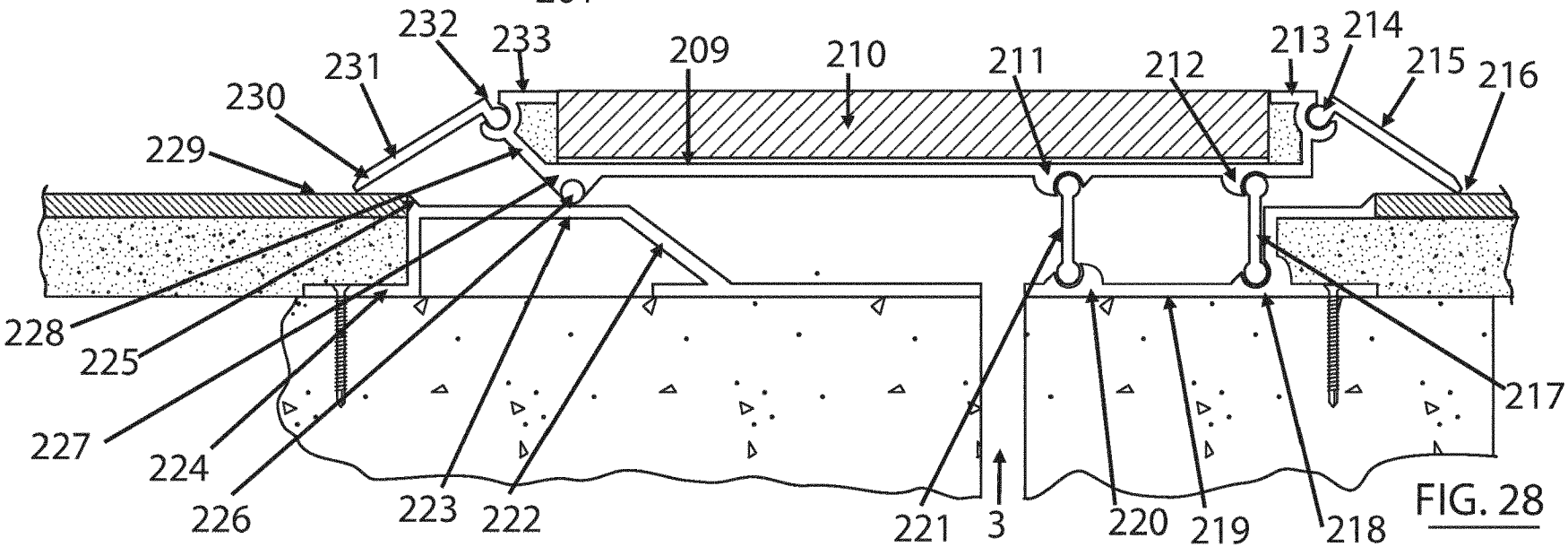
FIG. 28 shows a sectional view of the Type 4 device which incorporates a central pan with preferentially metal flanges or wings installed applied at either side of said pan after 'seismic deflection' has caused the expansion gap to close.

FIG. 28 depicts the Type 4 device in a situation where the expansion gap 3 has closed in response to structural movement to an extent greater than 'normal deflection' such as during a seismic event wherein the sloping face 228 of the central pan 209 comes into contact with the sloping face 222 of the outer frame 224 and the central pan 209 is forced upwards causing the barbell shaped sections 217 and 221 to rotate as shown thereby lifting the central pan 209 whilst ensuring that it remains parallel with the plane of the base of both the lower frame 219 and the outer frame 224. Further closure of the expansion gap 3 causes the central pan 209 to extend over and beyond the top of the opposing frame 224 and across the surface of the abutting substrate 229. As the central pan 209 lifts the flanges or wings 231 and 215 rotate within the sockets 232 and 214 such that the ends of these flanges or wings touch the finishes 229 and 216 thereby forming ramps at either side of the central pan. These ramps facilitate the passage of people across the expansion joint cover during and following a seismic event. As can be seen, the central pan has been forced upwards and when used in a flooring application the metal flanges or wings fold downwards under the force of gravity creating a ramp which aids the passage of pedestrians and wheeled vehicles passing across an expansion joint cover.

Figure 29:
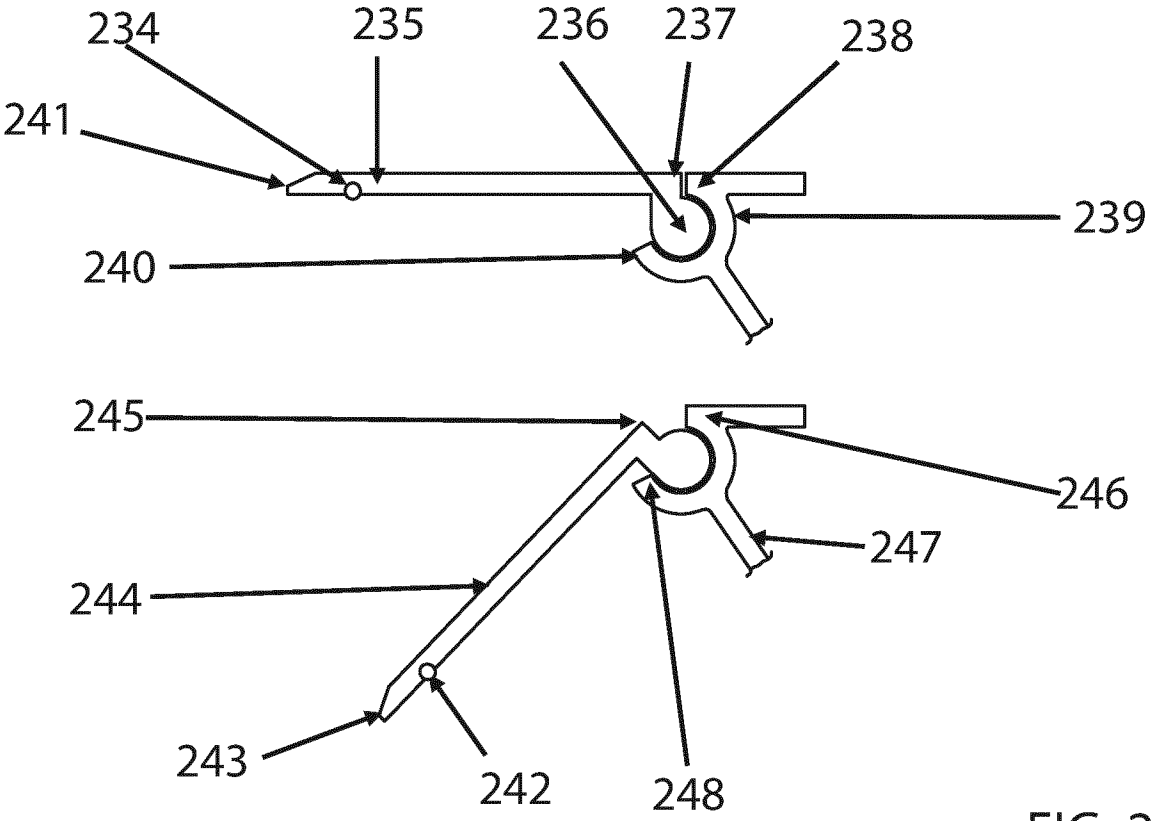
FIG. 29 shows a sectional view of one type of flange for use with the device in accordance with the present teachings where it connects to the central pan forming a hinge which can pivot to form a ramp.

FIG. 29 shows a sectional view of one type of flange for use with the device in accordance with the present teachings where it connects to the central pan forming a hinge which can pivot to form a ramp and thereby aid the passage of pedestrians and wheeled vehicles passing across an expansion joint cover installed in a floor. It will be appreciated that this configuration is merely exemplary. The person skilled in the art can choose any type of hinge structure as long as the wings or arms can move freely downwards (or towards the frame) as described herein.

In particular, FIG. 29 shows a typical detail of the rigid hinged flanges or wings 235 and 244 represented in FIGS. 26, 27 and 28. This figure comprises two drawings wherein the top drawing presents the end of a central pan 239 with a circular recess 238 which is greater than 180 degrees into which the largely circular end 236 of the arm 235 has been inserted. The flange 240 of the central pan section 239 and the upstand 237 of the flange or wing 235 limit the magnitude of rotation that the arm 235 can exhibit in one rotational direction whilst the end 240 of the central pan 239 limits the rotation of the arm 235 in the other direction.

FIG. 29 shows the flange or wing in two positions where the upper drawing displays the flange or wing 235 in its position during phases of 'normal deflection' as shown in FIGS. 25 and 25 wherein the upstand 237 meets the edge 237 of the central pan thereby maintaining the position of the flange or wing 235 parallel with the surface of the central pan. The lower drawing shows the flange or wing 244 in a sloping position such as may be experienced during a seismic event where the central pan is forced upwards as described in FIGS. 26 and 28. The magnitude of rotation is limited to the point where the lower face of the flange or wing 244 touches the outer edge 248 of the end of the central pan 247.

As noted earlier within some structures items such as services, acoustic suppression materials, fire barriers, waterproofing membranes and other devices may be incorporated within an expansion gap provided the gap is wide enough to accommodate anticipated deflection and not impact the items installed within said expansion gap. As a result, it may be desirable to inspect these items periodically and most particularly after a seismic event to determine whether they have remained unaffected or need to be replaced. The normal method of achieving this is to remove the entire expansion joint cover and in doing so abutting finishes are often compromised and must be replaced. Ideally only the central plate or pan would be removed, inspection and where required repairs or replacement of affected parts undertaken, and the central pan or plate replaced afterwards.

FIGS. 30 to 34 show another embodiment of the expansion joint cover in accordance with the present teachings, which meets this need to remove the central pan. In particular, FIGS. 30 to 34 inclusive show a version of the device where the central pan can be removed to facilitate inspection of the expansion gap without affecting abutting finishes. Similarly when the central pan has been removed any components or materials located within the expansion gap can be repaired or replaced as required. It should be appreciated that while the embodiment of FIGS. 30-34 is shown with respect to the pan configuration of FIG. 14 (Type 2 device), this is merely exemplary and any of the centre pan configurations shown herein are compatible with the embodiment of FIGS. 30-34.

Figure 30:
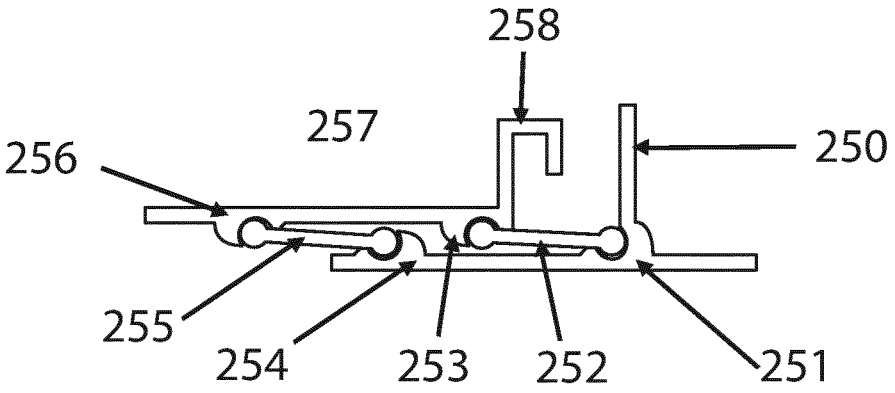
FIG. 30 shows another version of the frame of the device in accordance with the present teachings adapted so that a centre pan can be removed to accommodate inspection of the expansion gap.

FIG. 30 shows a lower frame 250 which includes C-shaped recesses 251 and 254 for the entrapment of the ends of barbell-shaped sections 252 and 255 said barbell-shaped sections being further attached by C-shaped retainers 253 and 256 formed in an upper plate 257. A centre pan may be affixed to the upper plate 257. The barbell sections 252 and 255 may optionally comprise solid formed metal sections, torsion springs or hydraulic components and serve to rotate under 'seismic deflection' raising any affixed centre pan above the level of abutting substrates thereby allowing any expansion gap to fully close. The torsion springs or hydraulic components force the affixed central pan to return to its normal position following a full closing and opening movement cycle. FIG. 30 also disclosed an upstanding section with an overhang 258.

Figure 31:
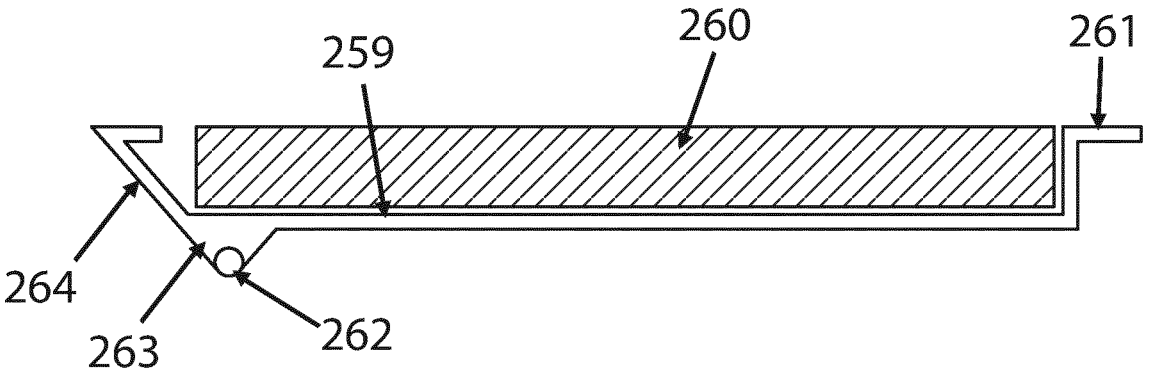
FIG. 31 shows a modified central pan which has been designed to be fitted to the frame shown in FIG. 30.

FIG. 31 shows a central pan 259 which has been designed to be affixed to the device disclosed in FIG. 30. This central pan comprises a frame 259 with a recess into which an infill 260 such as paving, cladding or other materials may be installed. Substantially this pan is like the central pan shown and described as Type 2 in earlier drawings. In this iteration the central pan has an L-shaped flange 261 which extends from one face of the pan and a sloped face 264 extending from the opposite face. An arm or extension 263 contains a recess 262 into which a roller or seal may be installed.

Figure 32:
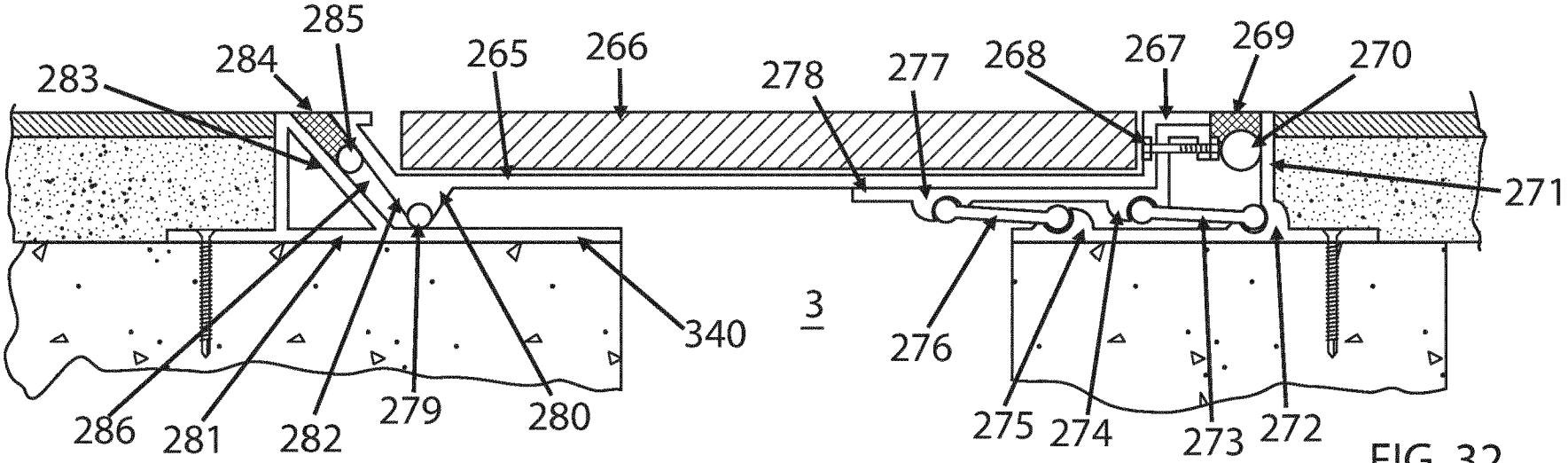
FIG. 32 shows another embodiment of the device in accordance with the present teachings with the central pan shown in FIG. 31 provided therein and fixed to the frame shown in FIG. 30 by means of bolts.

FIG. 32 shows where the components described in FIGS. 30 and 31 are fixed together. The pan 265 containing an infill 266 has been affixed to the assembly described in FIG. 30 by means of bolts and nuts 268 such that these fixings are hidden within the infill 266. Alternatively, the central pan 265 may be fixed to the underlying device described in FIG. 30 by means of countersink head machine screws fixed through the upper surface 267 of the L-shaped flange and into the upper frame 278 as explained in more detail hereinafter.

Figure 33:
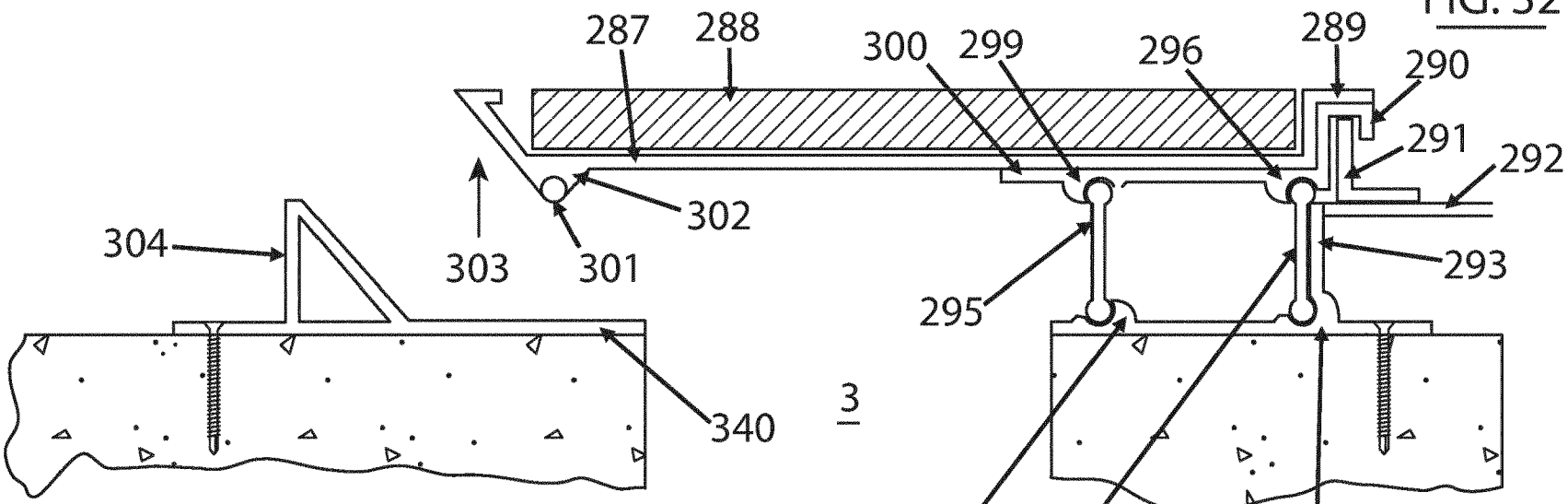
FIG. 33 shows a configuration wherein the modified central pan noted in FIG. 31 has been manually lifted or levered upwards causing the barbell shaped components to rotate lifting the central pan above the level of the abutting finishes.
Figure 34:
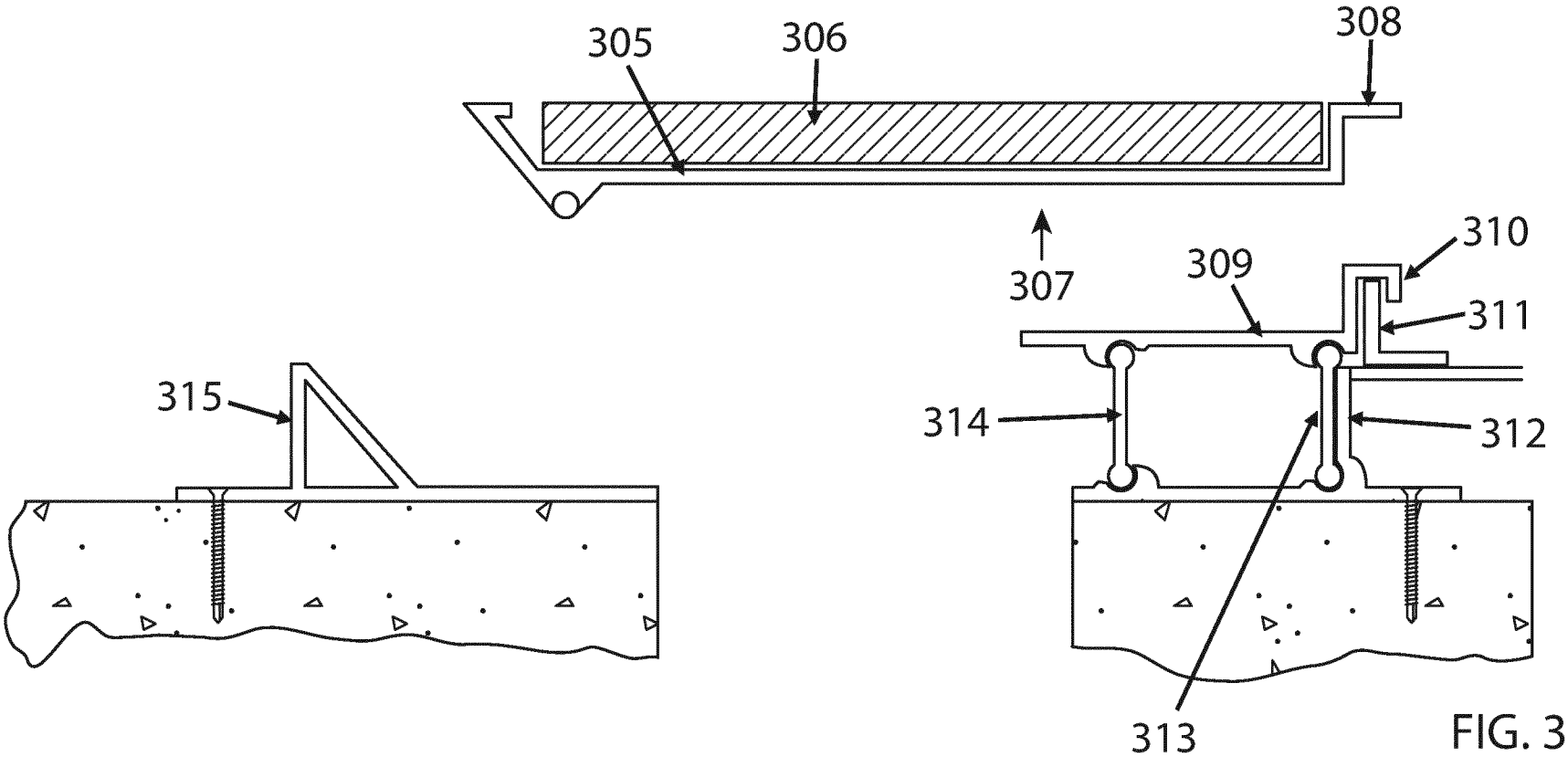
FIG. 34 shows a situation where the bolts securing the central pan to the upper frame have been removed wherein the central pan can be lifted out of position revealing the expansion gap and allowing inspection, repair or replacement of any components located within said expansion gap.

FIG. 33 shows the first step in removal of the central pan wherein the central pan 287 has been levered upwards causing the barbell shaped components 295 to rotate lifting the pan 287 above the level of the abutting finishes 292. L-shaped braces are then engaged within the upper frame while resting on abutting finishes such that the central pan and upper frame are secured in place. In this position a device such as an angled piece of metal 291 can be inserted into the inverted U-channel of the upper frame 300 such that the central pan 287 is fixed in this position. The nuts on the ends of the bolts shown as 268 in FIG. 32 can then be removed and the central pan lifted out of position as shown in FIG. 34. It should be noted that while the bolts and nuts 268 are not shown in FIG. 33, these are still present. They are simply removed from this figure for improved visibility.

FIG. 34 shows a situation where the bolts securing the central pan to the upper frame have been removed wherein the central pan can be lifted out of position revealing the expansion gap and allowing inspection, repair or replacement of any components located within said expansion gap. Once this inspection has been completed then the central pan can be replaced, the L-shaped brace removed, and the joint returned to its normal position.

It should also be noted that this system also allows the central pan to be replaced in the event of damage or in instances where 'seismic deflection' has occurred and the either the expansion joint cover has been lifted out of the gap and not returned to its normal position lying flush with surface of abutting finishes or the gap has opened substantially such that the space between the edge of the outer frame and the central pan are unacceptable due to either aesthetic or functional reasons. In this instance a narrower or wider central pan or plate can be installed without affecting surrounding finishes.

FIG. 35 shows an alternative means of fixing the central pan 317 to the underlying composite frame noted in FIG. 30 wherein the central pan 317 with an infill 318 has been attached to the underlying composite frame by means of countersink machine screws 316 fitted through the L-shaped flange of the central pan 317. In this design these screws are visible and accessible from the surface of the device rather than hidden as shown in FIG. 32.

FIG. 35 shows an iteration of the device where the modified central pan noted in FIG. 31 has been fixed with a machine screw from the surface to the underlying upper frame. This shows a modified version of the lower frame 7 shown in FIG. 1. In this version the lower frame is connected via barbell shaped sections to an upper frame described in FIG. 30 which has been adapted so that a centre plate or pan can be removed to accommodate inspection of the expansion gap.

FIG. 36 shows the machine screw being removed from the device displayed in FIG. 35 and the central pan being removed.

It will be appreciated that while this configuration of figures is 35 and 36 is described with respect to the Type 2 device, this configuration can be used in conjunction with a any central pan or central plate as outlined in more detail hereinafter.

FIG. 36 displays the means by which the central pan 319 with its infill 320 can be removed from the composite frame 323 without having to lever the central pan or plate upwards thereby making removal of said pan simpler to remove and replace when compared to the procedure shown in FIGS. 32, 33 and 34. The fixing screws 321 are removed releasing the central pan from the underlying composite frame 323 with the only drawback being that said fixing screws are visible in the surface of the device.

The configuration described with respect to FIGS. 35 and 36 is applicable to any of the previous embodiments. For example, with respect to the Type 1 device, the countersink machine screws can be inserted through the surface of the central plate. This is shown with respect to FIG. 44 and described in more detail below.

Turning to FIG. 37, more details of how the expansion joint cover in accordance with the present teachings functions are provided. As the central pan or plate is fixed to only one side of the substrate its ability to accommodate movement in the shear plane is therefore theoretically unlimited however movement vertical to the plane of the joint is limited by the length of the barbells units 329 and 330 as is shown in FIGS. 37 and 38. In this instance the Type 2 device design shown in FIGS. 24, 25, 26, 27 and 28 is used for illustrative purposes.

In FIG. 37 the two substrates either side of the expansion gap 3 have been denoted as A and B respectively. In this illustration deflection of the structure has lifted side A (or side B has lowered) such that the central pan 326 has been forced upwards whilst the composite frame 333 to which it is attached remains in its former position. The attachment of the central pan 326 to the composite frame 333 causes a drag on the roller/seal 331 moving it to the position denoted as 332. As a result, the barbell shaped linkages 329 and 330 rotate upwards. The flange or wing 328 fitted to the central pan 326 rotates downward under the force of gravity creating a ramp which aids the passage of people or vehicles across the expansion gap cover.

FIG. 38 illustrates the situation where the other side B of the substrate lifts. In this event the entire central pan 334 which is fixed to the composite frame rises in response to the vertical deflection such that it is cantilevered above the substrate A. The flange or wing 338 fitted to the central pan 334 rotates downward under the force of gravity creating a ramp which aids the passage of people across the device.

In FIGS. 37 and 38, the Type 4 device of FIGS. 24-29 is shown responding to vertical movements in the substrate. FIG. 39 shows another embodiment of the present teachings similar to the Type 1 device but which can better accommodate vertical movement of the substrate. In particular, FIG. 39 shows a variation of the device as shown in FIGS. 1 to 5 inclusive wherein a central plate rather than a central pan as shown in FIGS. 37 and 38. In FIG. 39, the expansion gap cover comprises a central plate with flanges or wings similar to those illustrated in FIGS. 24 to 28 inclusive and in FIGS. 37 and 38.

FIG. 39 shows an outer frame 345 fixed with screws to a substrate wherein a lower plate 340 of this frame 345 extends towards the expansion gap 3. This lower plate also has a sloped section which extends upward to a top plate or top surface. The top surface of this frame 345 is substantially flat save for a sloping upstand at the end of the section. An outer face of the central plate 341 also slopes outwards such that the angles of both slopes are approximately the same and the faces are substantially parallel.

FIG. 39 also shows an arm 343 that extends from the base of the centre plate 341 where this arm entraps a roller mechanism or seal 344. The combination of the arm and roller mechanism 344 serve to both allow the device to move smoothly when the expansion gap 3 opens and closes and also allow an amount of vertical deflection between the level of the substrate on one side of the expansion gap 3 to the substrate on the other side.

FIG. 39 shows that a gap 350 has been left between the outer frame 345 and the sloping face of the central pan 341. This gap 350 can vary in width and is designed to accommodate 'normal deflections' of the structure such that it allows the expansion gap 3 to close until the outward sloping face of the central pan 341 touches the sloping face of the outer frame 345. The dimensions of the gap 350 are normally mirrored by the distance between the end of the flange or wing 342 and the beginning of the upstand of the outer frame 345. These equal dimensions allow closing movement which serves to accommodate deflections arising from 'normal deflection' forces.

FIG. 40 is a sectional view of the expansion gap cover of FIG. 39 after the expansion gap 3 has closed in response to 'normal deflection. In this figure the gap 351 between the outer frame 352 and the outer face of the centre plate 354 has closed by a similar amount to that of the expansion gap 3 such that the flange or wing 353 has been moved across the flat surface of the outer frame 352 until it touches the sloping edge of the outer frame 352. The width of the centre plate 254 and flange or wing 353 may be tailored to accommodate the maximum expected opening movement of the expansion gap 3 whether such movement arises from 'normal deflection' or 'seismic deflection.

FIG. 41 depicts the expansion joint cover of this embodiment in a situation where the expansion gap 3 has closed in response to structural movement to an extent greater than 'normal deflection' such as during a seismic event wherein the sloping face of the central pan 361 comes into contact with the sloping face of the outer frame 355 and the centre plate 361 is forced upwards causing the barbell shaped sections 358 and 359 to rotate as shown thereby lifting the central pan 361 whilst ensuring that it remains parallel with the plane of the base of both the lower frame and the outer frame 355. Further closure of the expansion gap 3 causes the centre plate 361 to extend over and beyond the top of the opposing frame 355 and across the surface of the abutting substrate. As the centre plate 361 lifts the flanges or wings 357 and 360 rotate within their sockets such that the ends of these flanges or wings touch the finishes thereby forming ramps at either side of the centre plate. These ramps facilitate transit across the expansion joint cover during and following a seismic event.

FIG. 42 is a sectional view of the expansion joint cover of this embodiment after the expansion gap 3 has opened in response to 'normal deflection'. In this figure the gap 363 between the outer frame and the centre plate has opened by a similar amount to that of the expansion gap 3 such that the flange or wing 364 has been withdrawn across the flat upper surface of the outer frame to accommodate the movement. The width of the central pan and the flange or wing 364 may be tailored to accommodate the maximum expected opening movement of the expansion gap 3 whether such movement arises from 'normal deflection' or 'seismic deflection'.

FIG. 43 represents the expansion joint cover of this embodiment after the expansion gap 3 has opened in response to 'seismic deflection'. In this figure the gap 365 between the outer frame 367 and the centre plate 368 has opened by a similar amount to that of the expansion gap 3 such that the flange or wing 366 has been withdrawn across the flat upper surface of the outer frame 367 to accommodate the movement. In this situation the end of the flange or wing 366 can rotate downwards until it touches the sloping face of the outer frame 367. The width of the central pan 368 and the flange or wing 366 may be tailored to accommodate the maximum expected opening movement of the expansion gap 3 whether such movement arises from 'normal deflection' or 'seismic deflection'.

In addition, while a roller is provided in the embodiment of FIGS. 39-43 for sliding on surface 340, this is not essential. A similar configuration to that of FIG. 1 could be employed wherein the flat plate slides on a protruding tongue.

As previously mentioned, the configuration described with respect to FIGS. 35 and 36 is also applicable to the Type 1 device. That is, in such an embodiment of the expansion joint cover, the centre plate can be removed. FIG. 44 shows a means of fixing the centre plate 370 to the underlying composite frame 372 as noted in FIG. 30 wherein the centre plate 370 has been attached to the underlying composite frame 372 by means of countersink machine screws 375 fitted through the centre plate 317 and thereby securing it to the underlying composite frame 372. In this design these screws are visible and accessible from the surface of the device allowing the centre plate to be removed to permit inspection of the expansion gap 3. While, wings or flanges 371 are shown in FIG. 44, these are optional and a configuration similar to the Type 1 device without such wings 371 may be used in conjunction with the removal plate configuration of FIG. 44.

It will also be appreciated by the person skilled in the art that a variation of the design of FIG. 44 may employ the seals shown with respect to FIGS. 14-24. That is, the seals can also be used in conjunction with the flat central plate and are not restricted to the central pan embodiments. It will also be understood that the Type 1 device may employ the aforementioned seals (FIGS. 14-23) or wings (FIGS. 24-29) regardless of whether the plate is configured to be removable or not.

In addition, while a roller is provided in the embodiment of FIG. 44 for sliding on surface 340, this is not essential. A similar configuration to that of FIG. 1 could be employed wherein the flat plate slides on a protruding tongue.

FIG. 45 shows a sectional detail of the Type 2 device wherein the centre plate shown in FIGS. 1, 2, 3, 4, 5, 11 and 12 has been replaced by a pan system 376 into which an infill 377 such as paving, cladding or other materials may be installed. This both increases the load capacity and reduces the visual impact of the expansion joint cover. The pan 376 spans the expansion gap 3. In this form the device comprises a central pan 376 with outward sloping ends and a central recess for the installation of varying types of finish 377. The ends of the central pan 376 may alternatively extend at 90 degrees from the pan base. The expansion joint cover is fixed to the respective substrates 387 either side of the expansion gap 3 by means of screw or bolt fixings 386 and these fixings transfer movement forces within the structure to the expansion joint cover.

FIG. 45 shows a frame 396 fixed with said screws and bolts wherein the face of this frame that points inwards towards the expansion gap 3 slopes outwards. The outer face of the central pan 376 also slopes outwards such that the angles of both slopes are approximately the same.

FIG. 45 also shows an arm 394 that extends from the base of the pan 376 where this arm 394 entraps a roller mechanism or seal 395. The combination of the arm 394 and roller mechanism or seal 395 serve to both allow the device to move smoothly when the expansion gap 3 opens and closes and also allow an amount of vertical deflection between the levels of the substrate on one side of the expansion gap 3 to the substrate on the other side. The roller mechanism or seal 395 slides on a flat surface 400 of the frame 396.

FIG. 45 shows that a gap 382 has been left between the frame 396 and the sloping face of the central pan 376. This gap 82 can vary in width and is designed to accommodate 'normal deflections' of the structure such that it allows the expansion gap 3 to close until the outward sloping face of the central pan or plate 376 touches the sloping face of the opposing frame 396.

FIG. 45 includes a further innovative step wherein two protrusions, semi-circular elements 397 and 398, are shown. The first semi-circular element 397 is shown attached or adjacent to the end of outer frame 396 wherein 397 may be considered as an integral part of said frame or as a separate component abutting or separate from the outer frame 396. Similarly, a semi-circular element 398 is attached to the base of the central pan 376 in a position such that the distance 382 between the sloping surfaces of the outer frame 396 and central pan 376 is equal to the distance 399 between the semi-circular elements 397 and 398. When the expansion gap 3 closes the sloping faces of the outer frame 396 and central pan 376 touch at the same time as the semi-circular elements 397 and 398 meet. This feature is introduced for two reasons:

1. When installed in a floor the invention is designed to support both dead loads such as fixtures including items such as shelving, racking and lightweight room dividers as well as live loads arising from various types of traffic passing across the device. The load capacity of the system is proportional to the width of the unsupported span of the central pan or plate. The introduction of the semi-circular element 397 which is fixed to and supported by the substrate 387 and which is in contact with the base of the central pan or plate serves to reduce the width of the unsupported span of said central pan or plate thereby offering support and increasing the load capacity of the system.
2. As may be seen below in FIG. 48 and FIG. 49 as the expansion gap 3 closes to the point of 'normal deflection' the semi-circular elements 397 and 398 come into contact. Closing movement beyond 'normal deflection' capacity causes the central pan or plate 376 to lift which is induced by the outer sloping face of the central pan 376 meeting the sloping face of the outer frame 396. This lifting effect is aided by the contact between the semi-circular elements 398 and 398 which act as secondary lifting points as the central pan or plate 376 is forced upwards.

It should be appreciated by the person skilled in the art that both protrusions 397 and 398 do not have to be provided to the expansion joint cover and the expansion joint cover may comprise only one as deemed appropriate.

In FIG. 45 and further illustrations the protrusions or elements 397 and 398 have been shown as being semi-circular components; this is for illustration purposed and said elements could be formed as sloping angles or other shaped forms.

In FIG. 45 the gap 382 incorporates a backer rod 379 made from a flexible material such as foam polyethylene topped by a sealant 378 which is used to accommodate movement and prevent the ingress of water, dirt and other contaminants. A further backer rod 380 and seam of sealant 381 is installed on the opposite side of the pan system for similar reasons.

In FIG. 45 the lower frame 385 is affixed to the substrate 387 by screws or bolts 386. This frame 385 having C-shaped retainers 388 and 390 into which barbell shaped sections 389 and 389 are inserted said barbell-shaped sections 389 and 391 incorporating torsion springs or hydraulic mechanisms and these being further attached by C-shaped retainers 392 and 393 to the central pan 376. The C-shaped retainers 388, 390, 392 and 393 being designed to entrap the ends of the barbell shaped sections 389 and 391 whilst at the same time allowing them to rotate in response to pressure on the sloping outer faces of the central pan 376 by the sloping face of the opposing frame 396 when the expansion gap 3 closes sufficiently.

FIG. 46 is a sectional view of embodiments of the device described in FIG. 45 after the expansion gap 3 has opened in response to 'normal deflection' where the substrates 406 withdraw and either or both frames 405 and 409 retracted thereby increasing width of the expansion gap 3. The width of the central pan 401 may be tailored to accommodate the maximum expected opening movement of the expansion gap 3 whether such movement arises from 'normal deflection' or 'seismic deflection. In FIG. 46 it may be seen that the gap 408 between the outer frame 409 and the pan 401 has opened in response to the 'normal deflection' such that the seam of sealant 407 has been stretched.

FIG. 47 displays the device described in FIG. 45 following 'seismic deflection' wherein the expansion gap 3 has opened to its full extent and the central pan 415 has withdrawn opening a gap 421 between the face 423 of the central pan and the outer frame 422. This smooth operation of this action is aided by the roller/seal 424 sliding on the flat surface of the outer frame 422. In this instance the seam of sealant that had been inserted between the central pan 415 and the outer frame 422 is sacrificial has failed and, as a consequence has been eliminated from this drawing. The seam of sealant 418 and foam backer rod 417 remain in place.

FIG. 48 depicts a situation where the expansion gap 3 has closed in response to 'normal deflection' movement and the sloping face of the central pan or plate 415 meets the sloping face of the outer frame 437. This closure has forced the sealant and backer rod from the space between the central pan and the outer frame such that there is no gap 440 between these two components. In this instance the sealant has been ejected from the gap between the frames and has been omitted from the figure.

FIG. 48 also shows that following 'normal closing deflection' the semi-circular elements 443 and 444 come into contact as 445 demonstrates. Hence the central pan or plate 415 is in contact with the outer frame 437 at points indicated by 440 and 445.

FIG. 49 depicts a situation where the expansion gap 3 has closed in response to movement greater than 'normal deflection' and the sloping face of the central pan 449 has met the sloping face 458 of the outer frame 459 serving to lift the central pan 449 above the level of the finishes 460 such that the central pan 449 lies above the level of said finishes 460 by a distance indicated as 446. In addition, the radiused sections 461 and 462 formed at the end of the outer frame 459 and base plate of the central pan 449 come into contact and assist in forcing the central pan upwards. This action has in turn caused to barbell shaped units 452 and 457 to rotate upwards to accommodate the lifting forces being exerted upon the central pan 449. This closure has forced the sealant and backer rod from the space between the central pan and the outer frame. In this instance the sealant has been ejected from the gap between the frames and has been omitted from the figure.

FIG. 50 depicts the Type 2 expansion joint cover in a situation where the expansion gap 3 has closed in response to 'seismic deflection' movement to an extent greater than 'normal deflection' such as during an earthquake wherein the sloping face 476 of the central pan 463 comes into contact with the sloping face 472 of the opposing frame 473 and the central pan 463 is forced upwards causing the barbell shaped sections 466 and 471 to rotate upwards thereby lifting the central pan 463 whilst ensuring that it remains parallel with the plane of both the lower frame 468 and the opposite frame 473. Further closure of the expansion gap 3 causes the central pan 463 to extend over and beyond the top of the opposing frame 473 and across the surface of the abutting substrate 475. This smooth operation of this action is aided by the roller/seal 474 which is fitted within an extension 477 of the central pan 463. In this type of seismic deflection event the seams of sealant and backer rods which had been inserted either side of the central pan 463 are sacrificial have failed and have been eliminated from this drawing.

While the embodiments described herein include a frame section with multiple C-shaped retainers into which barbell shaped sections 11 and 12 are inserted and said barbell-shaped sections being further attached by C-shaped retainers to a centre plate or pan, the present teachings are not limited to such a configuration. Any type of connector may be used in place of the C-shaped retainers. Furthermore any type of linkage section may be used in place of the barbell-shaped section. For example, although the C-shaped retainers may be considered female connectors with the barbell-shaped section including male connectors for insertion in the female connectors, this does not have to be the case. The frame and centre plate/pan may be fitted with male connectors and the linkage fitted with female connectors. Many other configurations can be envisioned as long as linkage section can pivot within the connectors to allow movement of the centre section (plate or pan) with respect to the frame section to which it is attached. In particular, the linkage section and connectors must allow the centre section (pan or plate) to remain parallel with the frame even after it moves vertically away from the frame.

It will also be appreciated that although two barbell shaped linkages are provided in the embodiments described herein, a single linkage may also be used. Furthermore, more than two linkages could be used.

It will be appreciated that the teachings described herein provide a significant improvement on the prior art central pan and centring bar systems by eliminating the need for centring bars.

The teachings described herein also provide significant improvement on the prior art hinge type systems by providing an expansion joint cover which doesn't present a trip hazard in floors as following closing movement its top surface lies parallel to the floor plane and meets current disability legislation. Similarly, this accommodates the passage of differing vehicle types.

When used in walls the expansion joint cover described herein does not expose the expansion gap to the elements and as it lies parallel with the plane of the wall it does not suffer the same impact from wind loading.

The present teachings offer the facility of removing a central plate or pan, conducting inspections, affecting replacements or repairs and replacing the central plate or pan without disturbing abutting finishes.

Furthermore, the mechanism by which the proposed device operates is considerably simpler and more robust than anything revealed in the prior art.

The words comprises/comprising when used in this specification are to specify the presence of stated features, integers, steps or components but does not preclude the presence or addition of one or more other features, integers, steps, components or groups thereof.

The invention claimed is:

1. An expansion joint cover for insertion in an expansion gap comprising:

a first frame section for attachment to a substrate at one side of the expansion gap, the first frame section configured to have a flat surface parallel to the substrate at the one side of the expansion gap;

a second frame section for attachment to a substrate at an opposite side of the expansion gap, the second frame section having a first set of connectors;

a center section configured to span the expansion gap and slide on the flat surface of the first frame section, the center section having a second set of connectors; and two linkage sections configured to engage with the first and second sets of connectors respectively, to connect the center section to the second frame section, wherein the two linkage sections can pivot with respect to the first and second sets of connectors to allow movement of the center section with respect to the second frame section and to allow vertical movement of the center section with respect to the flat surface of the first frame section while maintaining the center section parallel with the flat surface of the first frame section.

2. The expansion joint cover of claim 1 further configured such that during movement horizontal to the plane of the substrate at the one side of the expansion gap and/or the substrate at the opposite side of the expansion gap, at least a portion of the flat surface of the first frame section can slide under at least a portion of the center section and at least a portion of the center section can slide on at least a portion of the flat surface.

3. The expansion joint cover of claim 1 further configured such that when movement horizontal to the plane of the substrate causes the expansion gap to close to a predetermined point, the center section engages with a portion of the first frame section causing the center section to move vertically with respect the plane of the substrate.

4. The expansion joint cover of claim 3 wherein, the linkage sections are barbell shaped sections and pivot within the first and second sets of connectors to maintain the center section parallel with the flat surface of the first frame section, and wherein the first and second connectors are C-shaped retainers.

5. The expansion joint cover of claim 1 wherein the linkage is one of (i) a torsion spring, which applies force resisting vertical movement of center section with respect to the plane of the substrate and (ii) a solid linkage.

6. The expansion joint cover of claim 1 wherein at least one of the two linkage sections is a torsion spring, which applies force resisting vertical movement of the center section with respect to the plane of the substrate and at least one of the two linkage sections is a solid linkage.

7. The expansion joint cover of claim 1 wherein the connectors are C-shaped retainers, and the linkage sections are barbell shaped.

8. The expansion joint cover of claim 1 further comprising a first wing section attached to a first side of the central center section and extending to the first frame portion.

9. The expansion joint cover of claim 8 further comprising a second wing section attached to a second side of the center section and extending to the second frame portion.

10. The expansion joint cover of claim 8 wherein the wing section is configured to pivot with respect to the central center section.

11. The expansion joint cover of claim 1 wherein the center section is a flat plate.

12. The expansion joint cover of claim 1 wherein the center section is a pan with central recessed portion.

13. The expansion joint cover of claim 12 wherein the pan comprises an arm with a roller mechanism configured to slide on the flat surface of the first frame section.

14. The expansion joint cover of claim 12 wherein the first frame section further comprises an inclined portion extending from the flat surface configured for engaging with the pan.

15. The expansion joint cover of claim 12 further comprising a backer rod topped by a sealant between the pan and at least one of the first frame section and second frame section.

16. The expansion joint cover of claim 15 wherein the sealant is configured to stretch during movement horizontal to the plane of the substrate.

17. The expansion joint cover of claim 12 wherein the first frame section comprises a first recessed portion, the pan comprises a second recessed portion and a pre-extruded seal connects the first frame section and the pan via the first and second recessed portions.

18. The expansion joint cover of claim 17 wherein the second frame section comprises a third recessed portion, the pan comprises a fourth recessed portion and a seal connects the second frame section and the pan via the third and fourth recessed portions.

19. The expansion joint cover of claim 12 wherein the pan comprises at least one of a first side inclining towards the first frame portion and a second side inclining towards the second frame portion.

20. The expansion joint cover of claim 12 further comprising a first protrusion which extends from the flat surface of the first frame section and is configured such that the center section can slide on the first protrusion.

21. The expansion joint cover of claim 20 further comprising a second protrusion which extends from the center section and is configured to engage with the first protrusion.

22. An expansion joint cover for insertion in an expansion gap comprising:

a first frame section for attachment to a substrate at one side of the expansion gap, the first frame section configured to have a flat surface parallel to the substrate at the one side of the expansion gap;

a second frame section for attachment to a substrate at an opposite side of the expansion gap, the second frame section having an upper section with a first set of connectors and a lower section with a second set of connectors;

a center section configured to span the expansion gap and slide on the flat surface of the first frame section, the center section detachably connected to the upper section of the second frame portion; and two linkage sections configured to engage with the first and second sets of connectors, respectively, to connect the upper section of the second frame section with the lower section of the second frame section;

wherein the two linkage sections can pivot with respect to the first and second sets of connectors to allow movement of the upper section with respect to the lower section and to allow vertical movement of the center section with respect to the flat surface of the first frame section while maintaining the center section parallel with the flat surface of the first frame section, and the center section is removable from the expansion joint cover by detaching it from the upper section of the second frame section.

23. The expansion joint cover of claim 22 wherein the center section is a pan configured for attachment to the upper frame section using a countersink screw that extends through a portion of the pan into the upper frame section.

24. The expansion joint cover of claim 22 wherein the center section is a pan configured for attachment to the upper frame section using a bolt that extends through a portion of the pan and through a portion into the upper frame section.

25. The expansion joint cover of claim 24 wherein the bolt extends through an upstanding wall of the pan and through an upstanding portion of the upper frame section.

26. The expansion joint cover of claim 22 wherein the center section is a flat plate configured for attachment to the upper frame section using a countersink screw that extends through the plate into the upper frame section.

27. The expansion joint cover of claim 22 further comprising a first protrusion which extends from the flat surface of the first frame section and is configured such that the center section can slide on the first protrusion.

28. The expansion joint cover of claim 27 further comprising a second protrusion which extends from the center section and is configured to engage with the first protrusion.

* * * * *